US011202487B2

(12) United States Patent
Tung et al.

(10) Patent No.: US 11,202,487 B2
(45) Date of Patent: Dec. 21, 2021

(54) SLIDE FASTENER

(71) Applicant: YKK CORPORATION, Tokyo (JP)

(72) Inventors: Yu Chen Tung, Toyama (JP); Jiro Nozaki, Toyama (JP); Shigeyoshi Takazawa, Toyama (JP); Yoshinori Kojima, Toyama (JP); Shigeki Annaka, Toyama (JP)

(73) Assignee: YKK CORPORATION, Tokyo (JP)

( * ) Notice: Subject to any disclaimer, the term of this patent is extended or adjusted under 35 U.S.C. 154(b) by 0 days.

(21) Appl. No.: 16/647,750

(22) PCT Filed: Sep. 26, 2017

(86) PCT No.: PCT/JP2017/034816

§ 371 (c)(1),
(2) Date: Mar. 16, 2020

(87) PCT Pub. No.: WO2019/064356

PCT Pub. Date: Apr. 4, 2019

(65) Prior Publication Data

US 2020/0275745 A1 Sep. 3, 2020

(51) Int. Cl.
*A44B 19/38* (2006.01)
*A44B 19/36* (2006.01)
(Continued)

(52) U.S. Cl.
CPC ..... *A44B 19/38* (2013.01); *A44B 19/36* (2013.01); *A44B 19/06* (2013.01); *A44B 19/26* (2013.01); *A44B 19/34* (2013.01); *A44B 19/60* (2013.01)

(58) Field of Classification Search
CPC ..... A44B 19/06; A44B 19/26; A44B 19/38; A44B 19/36; A44B 19/34; A44B 19/60; A44B 19/388
See application file for complete search history.

(56) References Cited

U.S. PATENT DOCUMENTS 4,078,279 A 3/1978 Heimberger
4,742,603 A * 5/1988 Kasai ..... A44B 19/38 24/433
(Continued)

FOREIGN PATENT DOCUMENTS

CA 1121572 A 4/1982
JP 55-500279 A 5/1980
(Continued)

OTHER PUBLICATIONS

International Search Report and Written Opinion for related International Application No. PCT/JP2017/034816, dated Nov. 28, 2017; English translation of ISR provided (9 pages).

*Primary Examiner* — Robert Sandy
*Assistant Examiner* — Louis A Mercado
(74) *Attorney, Agent, or Firm* — Procopio, Cory, Hargreaves & Savitch LLP

(57) ABSTRACT

A first stop member includes a first base and a first insert that is positioned between the first base and a first fastener element and is inserted into the slider via a rear mouth of a slider. A second stop member includes a second base and a second insert that is positioned between the second base and a second fastener element and is inserted into the slider via a second slit of the slider. The second insert moves toward the second slit of the slider in accordance with at least one or respective rotations of the first and second bases. A rotational axis with respect to the at least one or respective rotations of the first and second bases is positioned between the first tape region and the second tape region.

9 Claims, 20 Drawing Sheets

(51) Int. Cl.

| | |
|---|---|
| *A44B 19/06* | (2006.01) |
| *A44B 19/26* | (2006.01) |
| *A44B 19/34* | (2006.01) |
| *A44B 19/60* | (2006.01) |

(56) References Cited

U.S. PATENT DOCUMENTS

| | | | |
|---|---|---|---|
| 6,088,888 | A | 7/2000 | Oda |
| 6,421,887 | B1 | 7/2002 | Oda et al. |
| 2003/0213106 | A1 | 11/2003 | Ichikawa et al. |
| 2008/0040901 | A1 | 2/2008 | Himi |

FOREIGN PATENT DOCUMENTS

| | | | |
|---|---|---|---|
| JP | 11-221105 | A | 8/1999 |
| JP | 2000-232908 | A | 8/2000 |
| JP | 3733343 | B2 | 1/2006 |
| JP | 2008-43568 | A | 2/2008 |

* cited by examiner

[Fig.1]
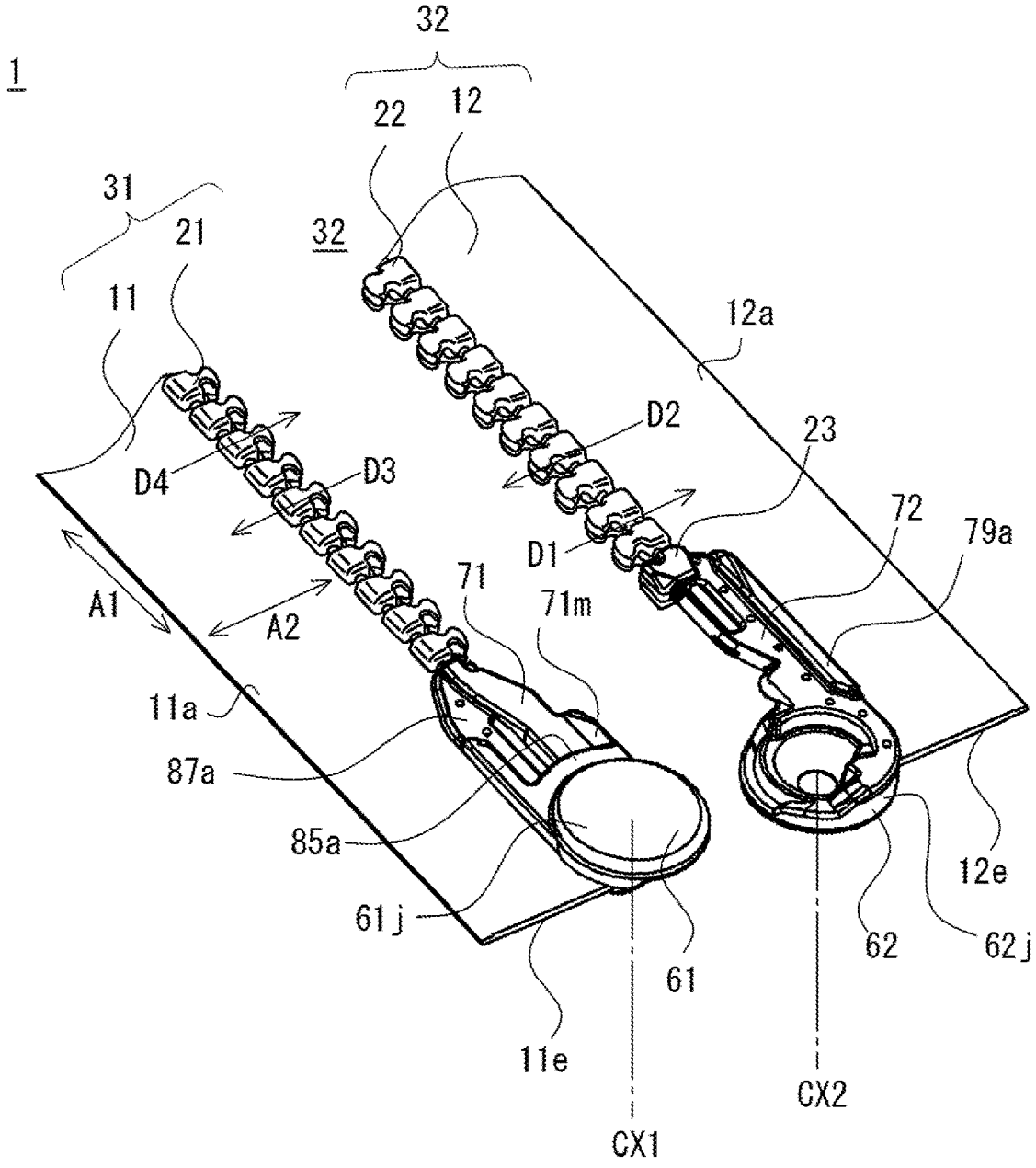

[Fig.2]
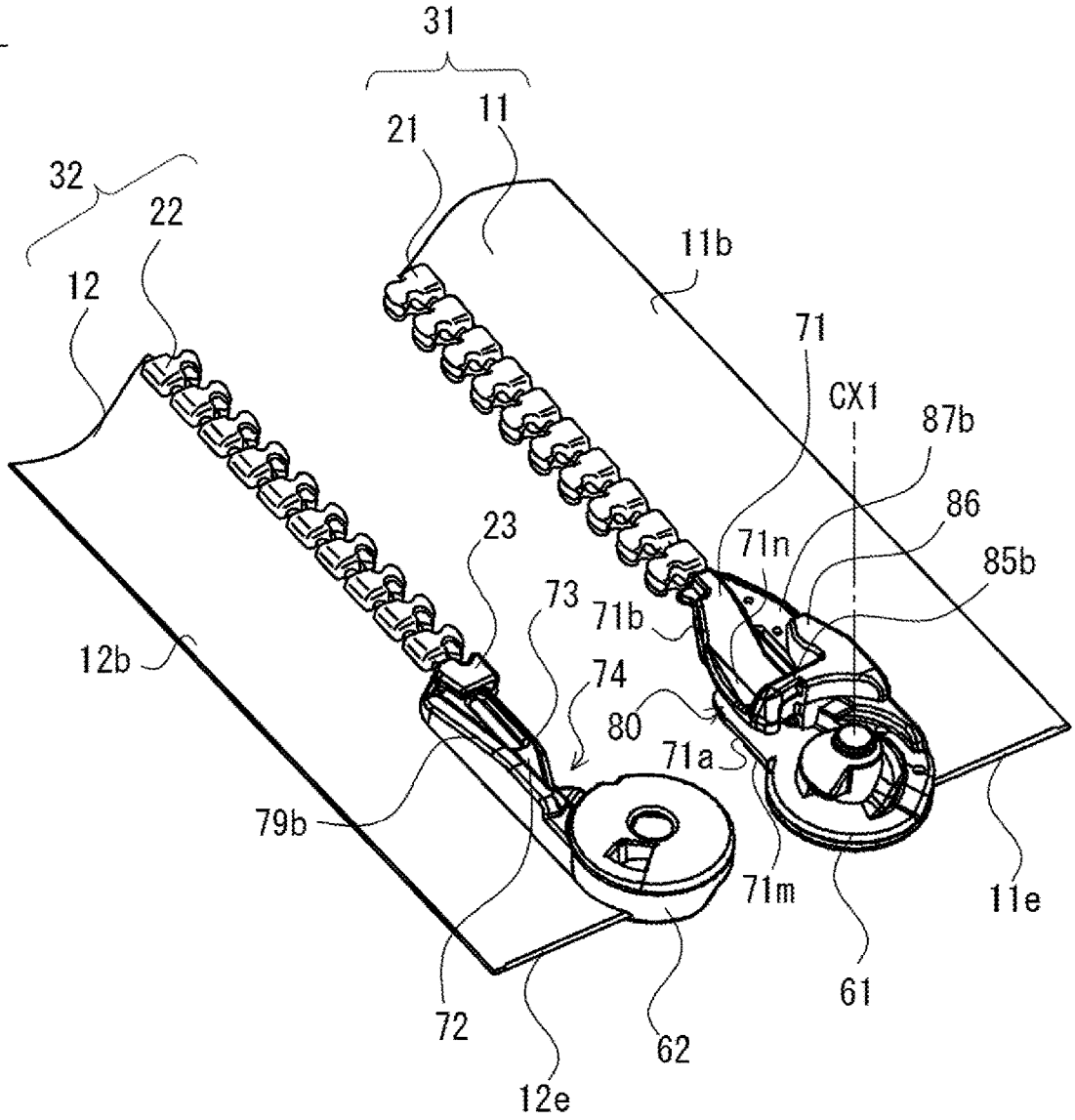

[Fig.3]
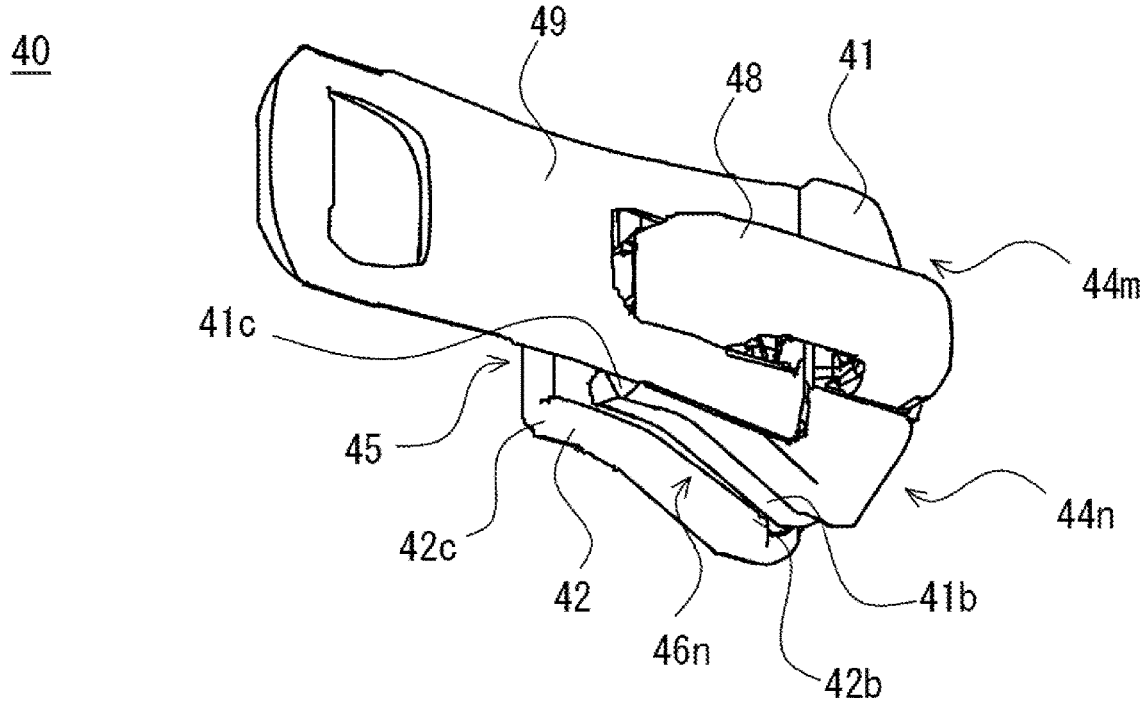

[Fig.4]
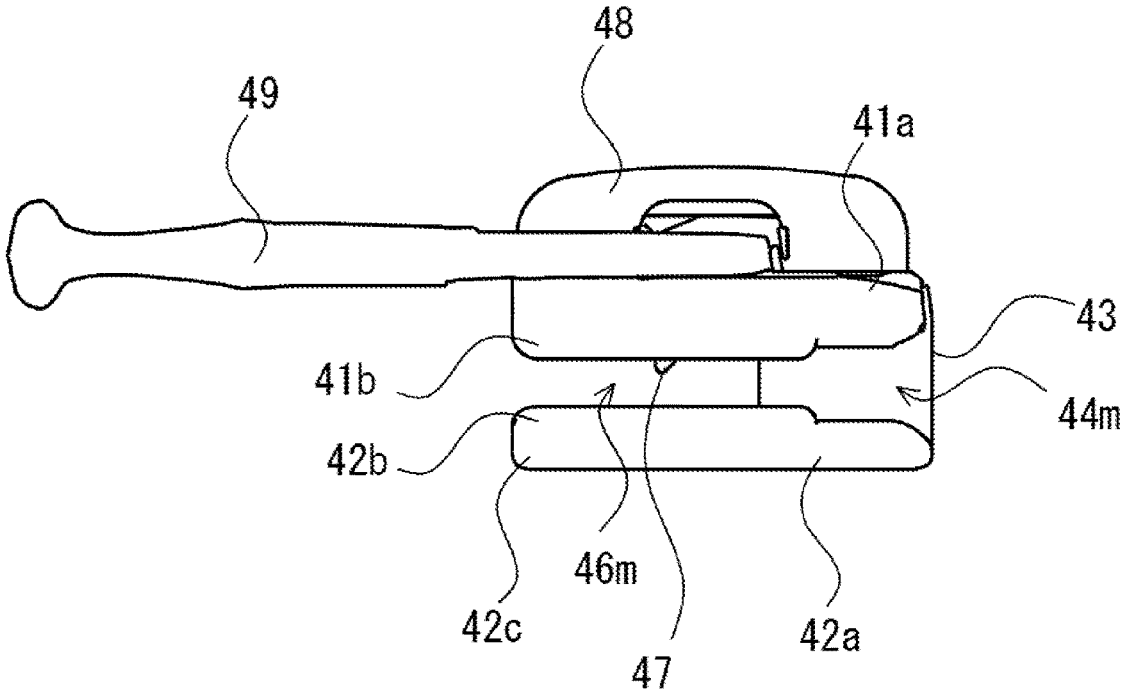

[Fig.5]
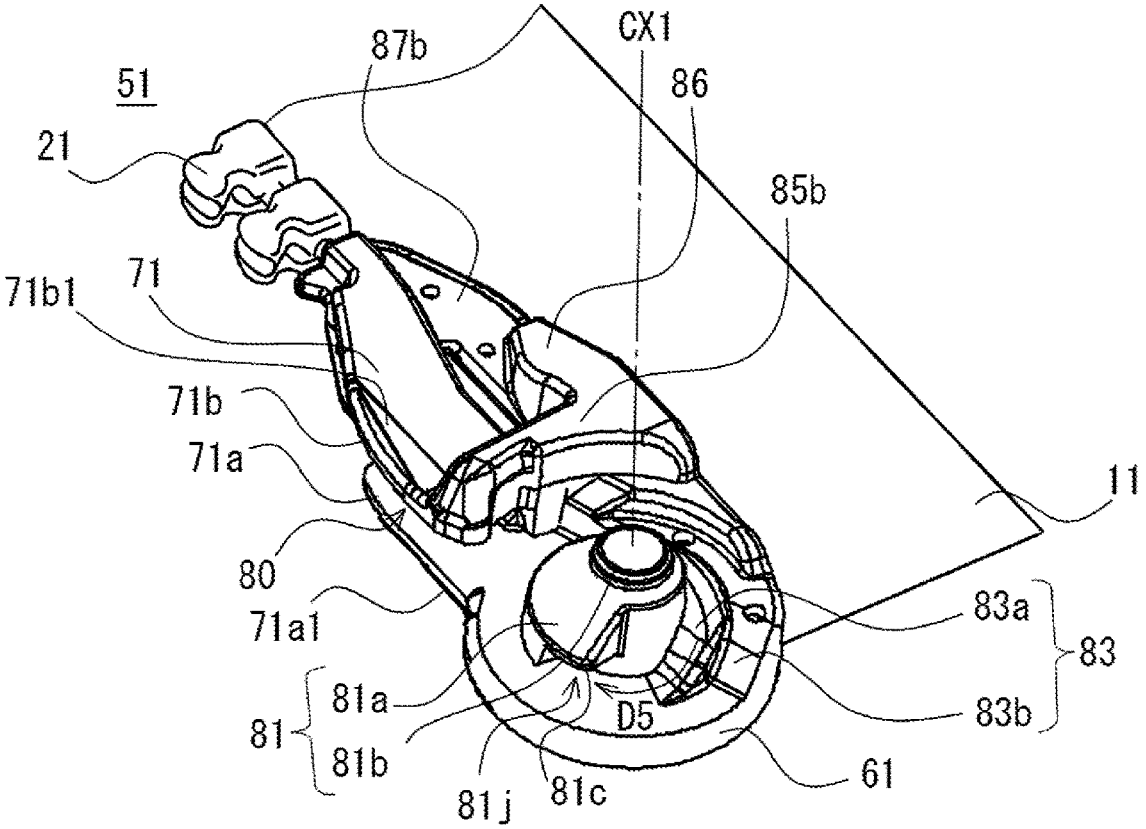

[Fig.6]
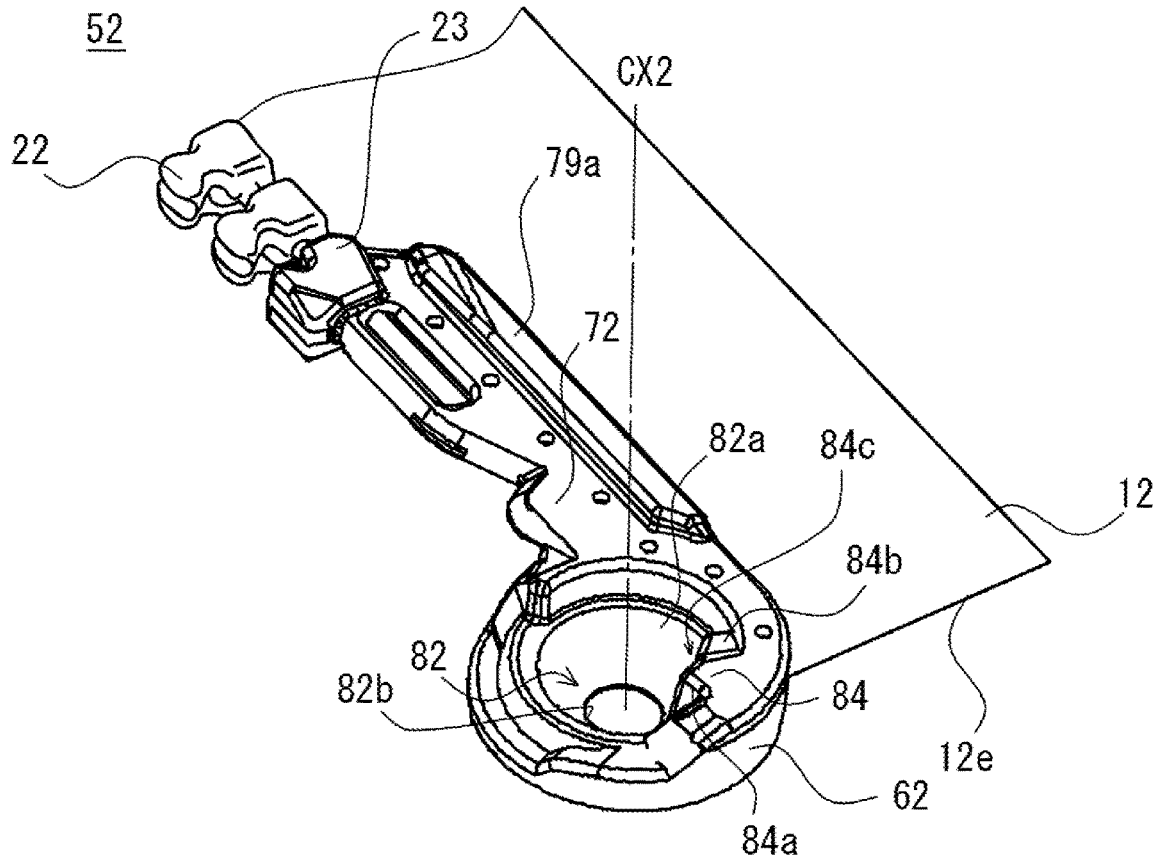

[Fig.7]
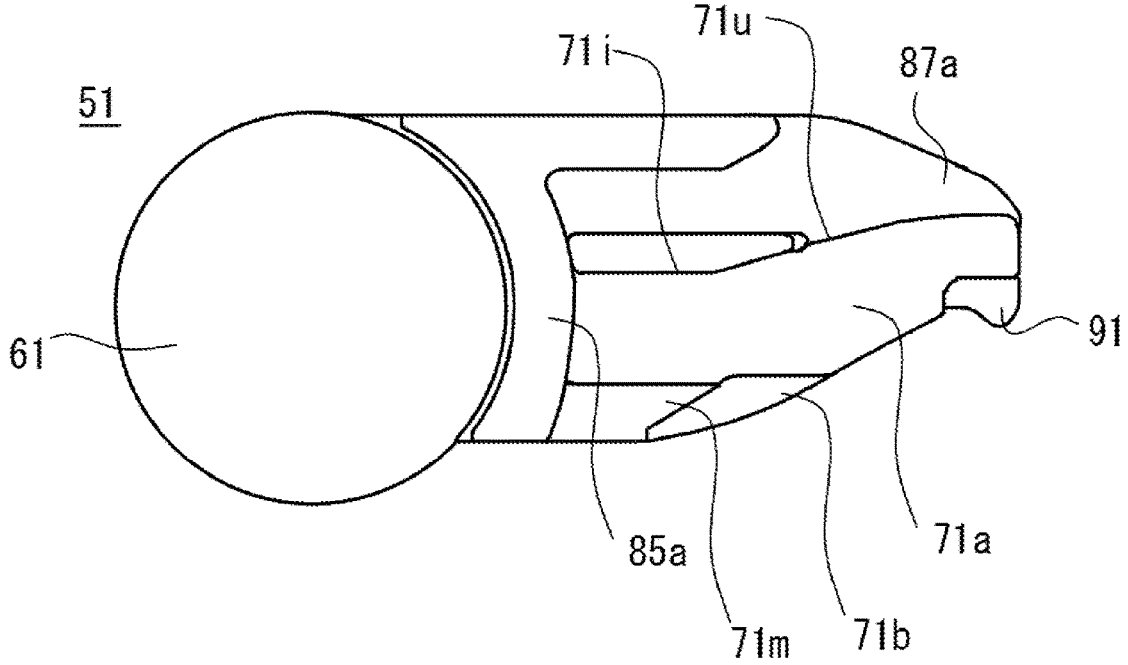

[Fig.8]
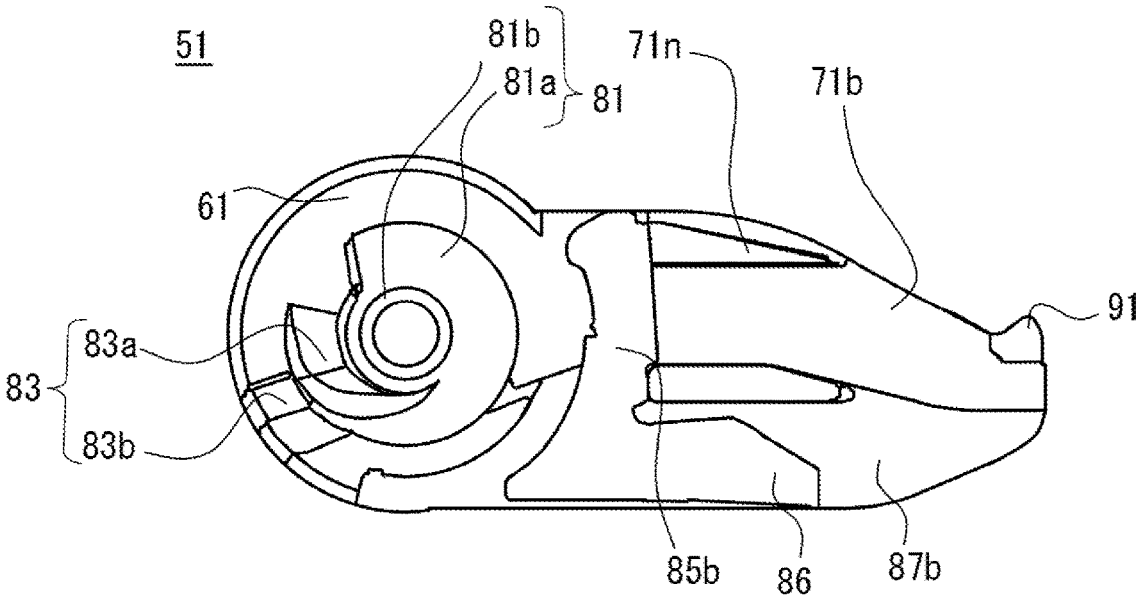
[Fig.9]
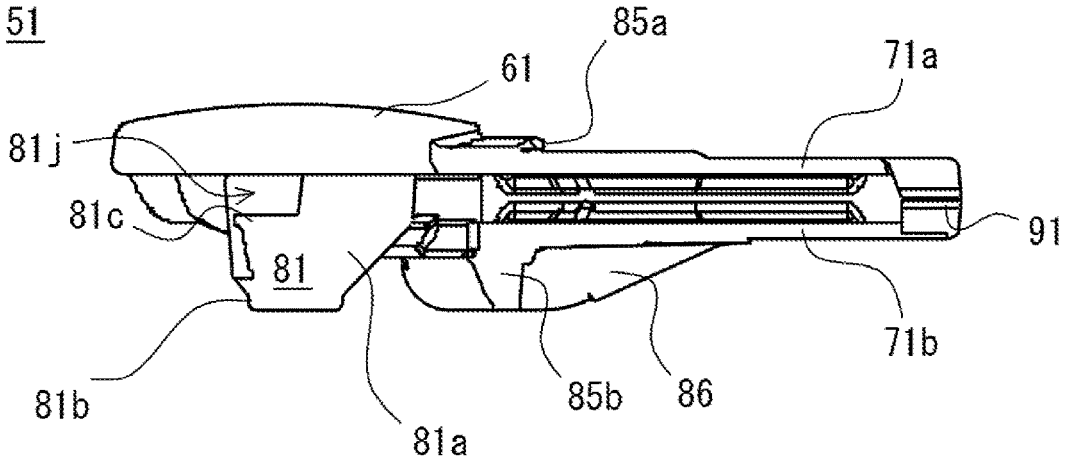

[Fig.10]
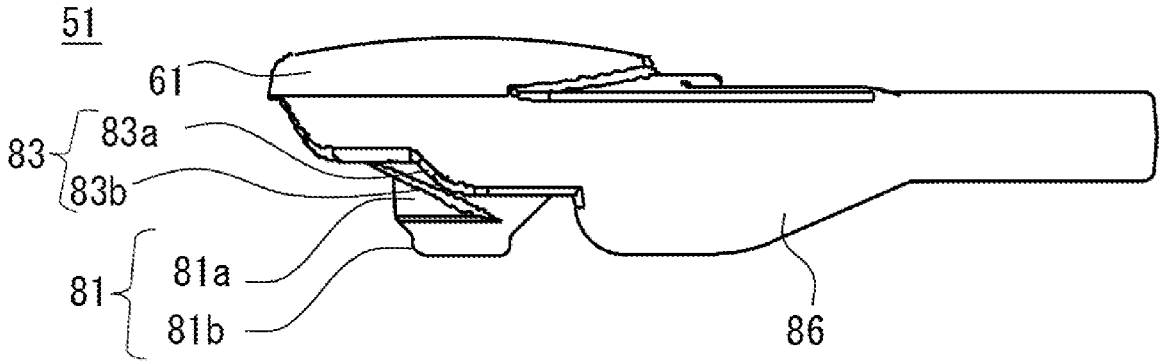
[Fig.11]
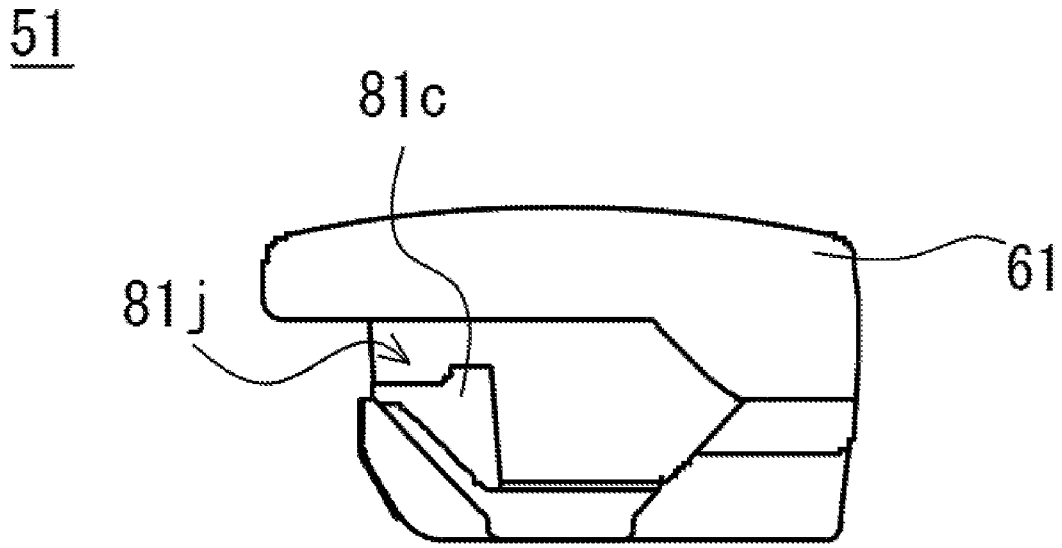

[Fig.12]
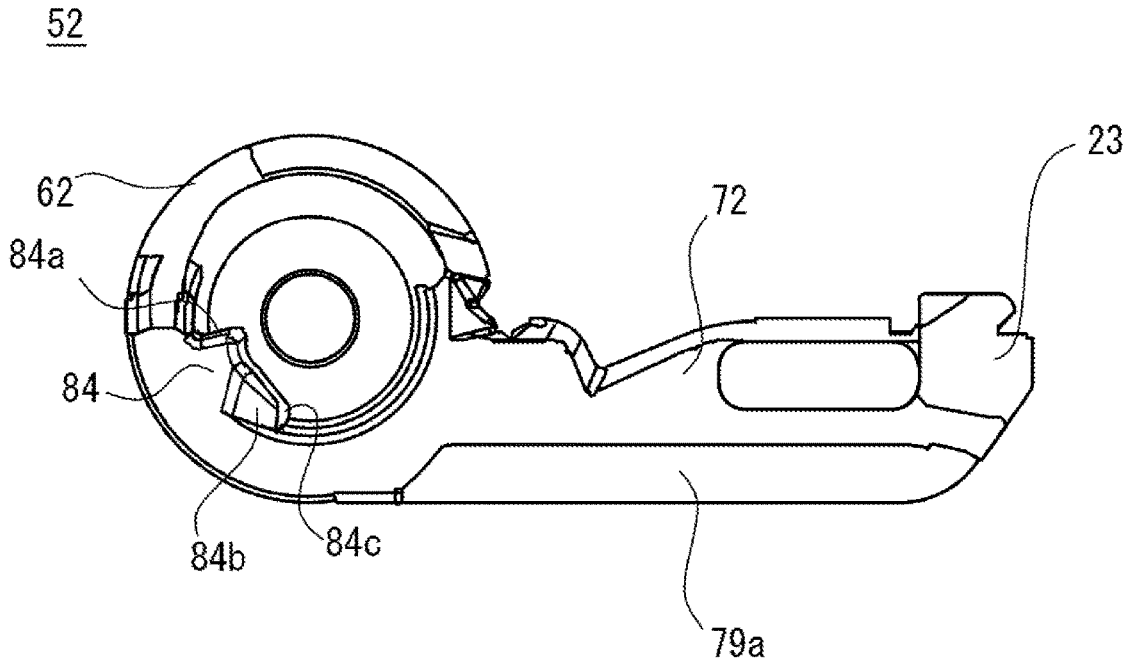
[Fig.13]
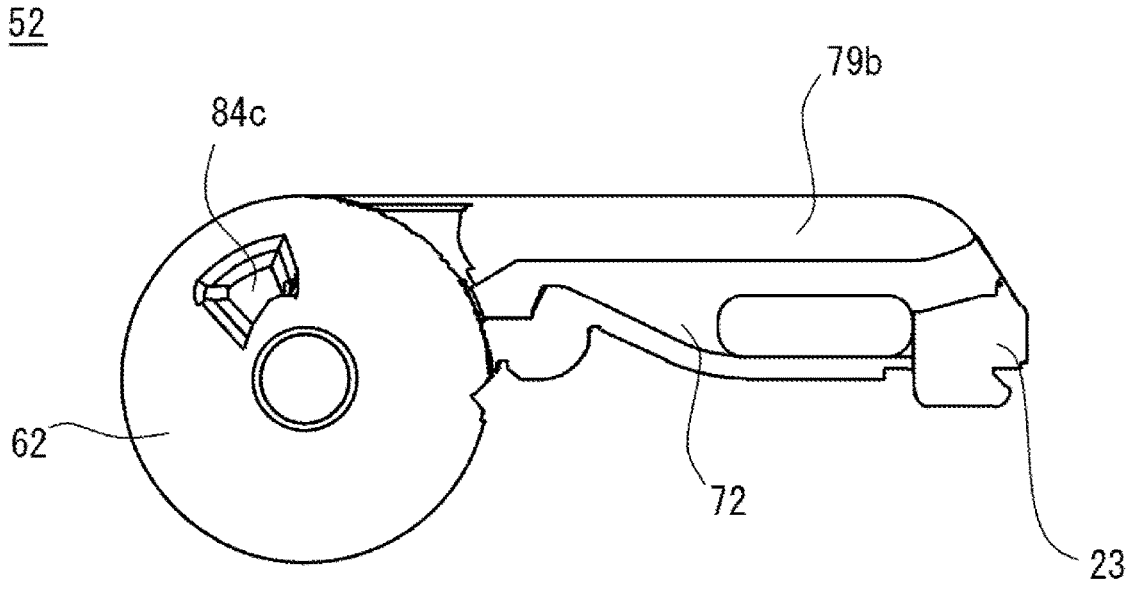

[Fig.14]
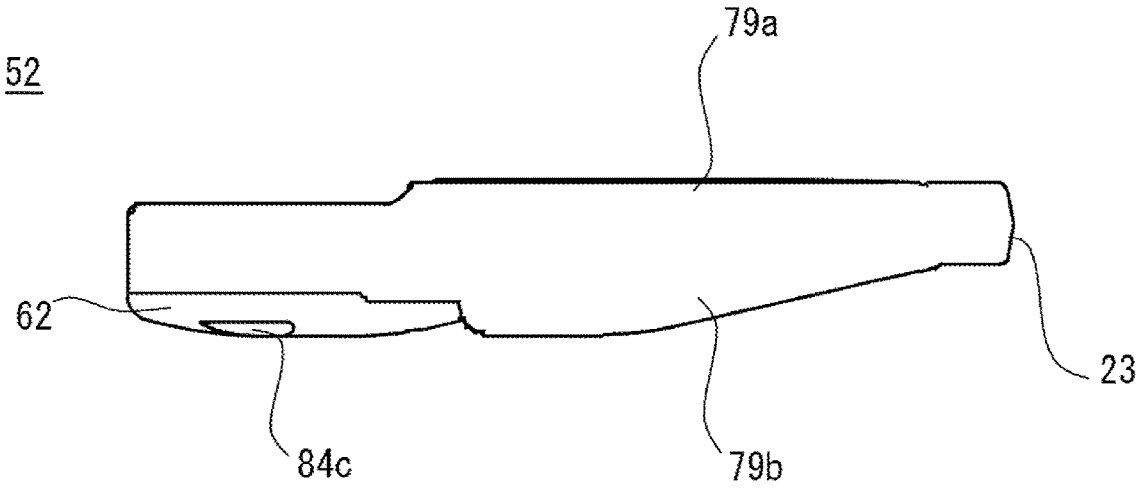
[Fig.15]
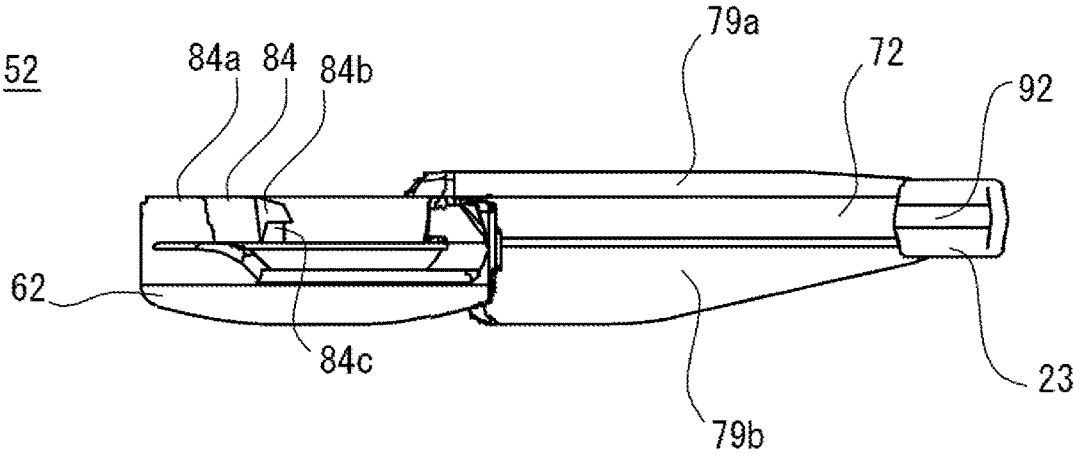

[Fig.16]
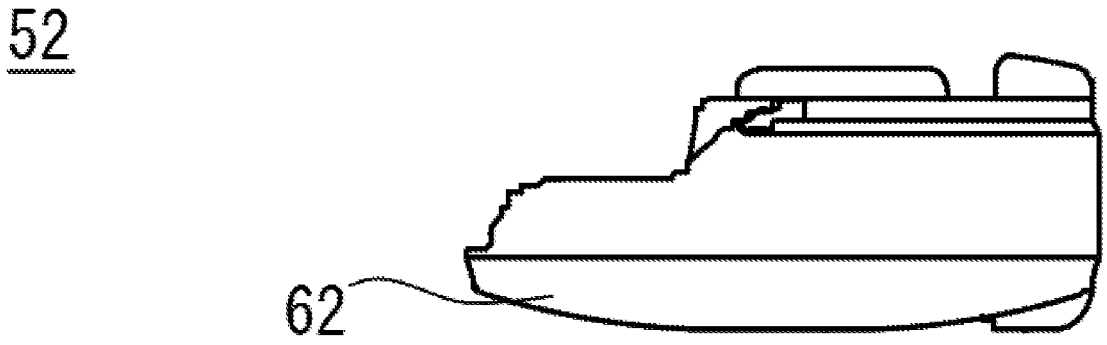

[Fig.17]
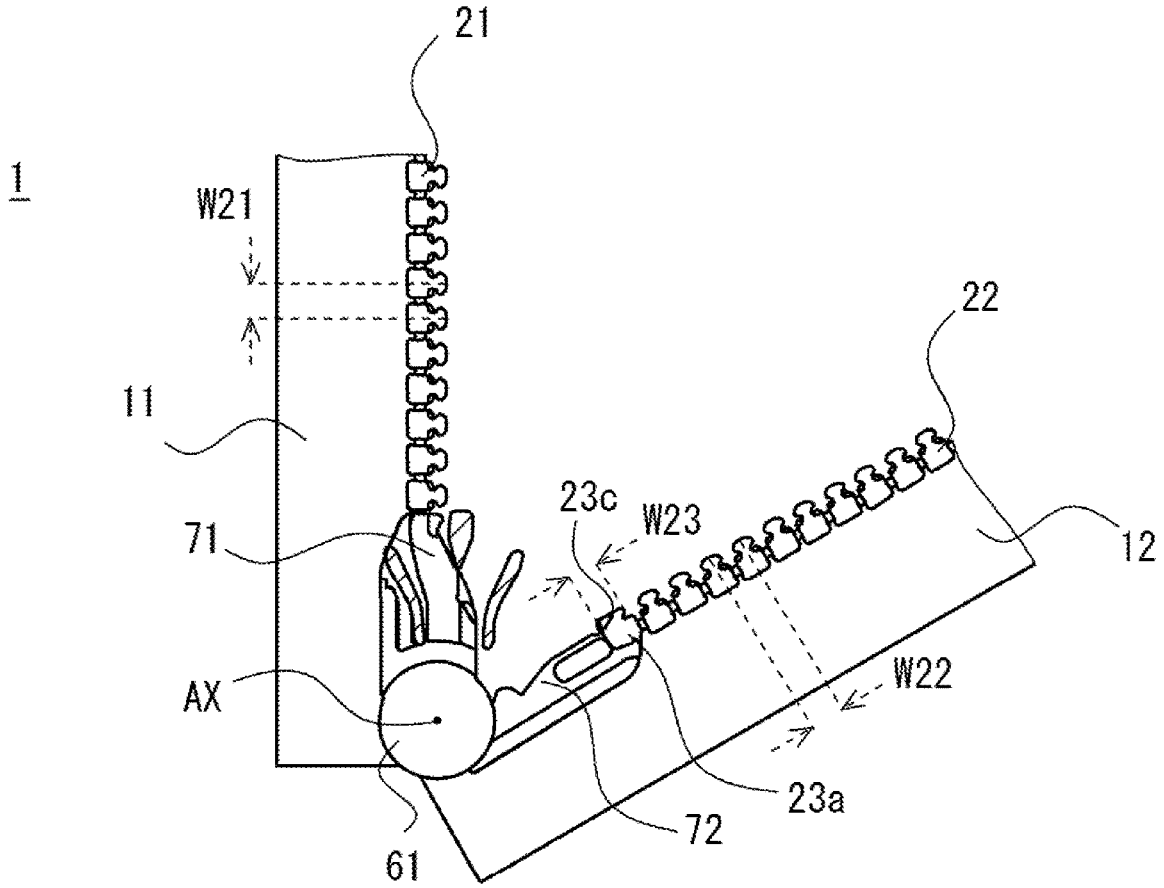

[Fig.18]
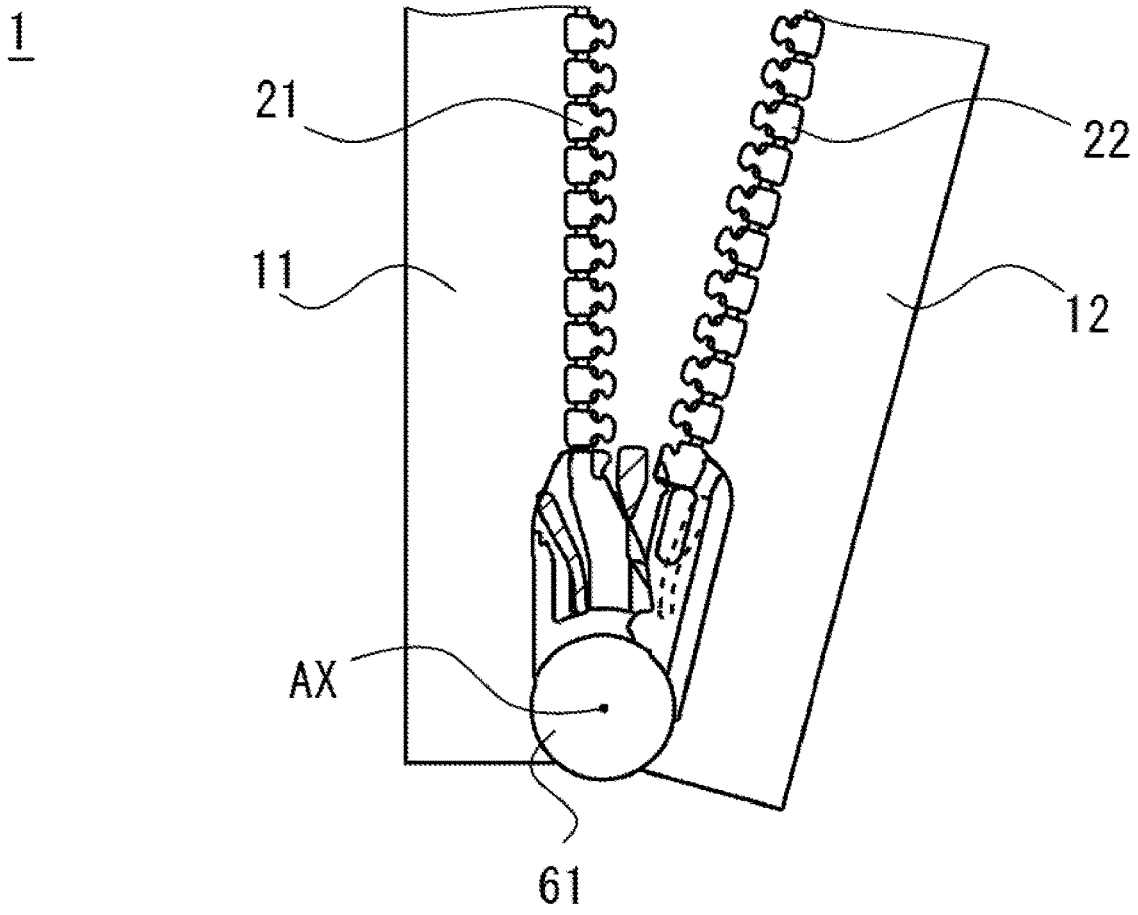

[Fig.19]
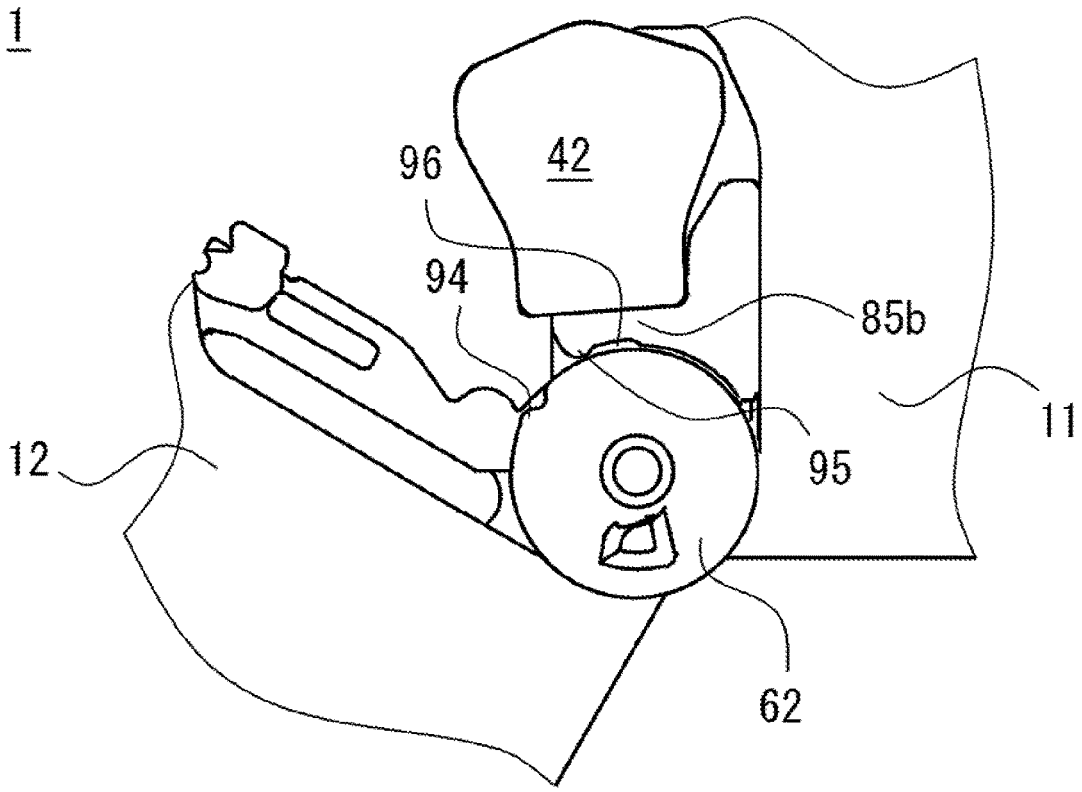

[Fig.20]
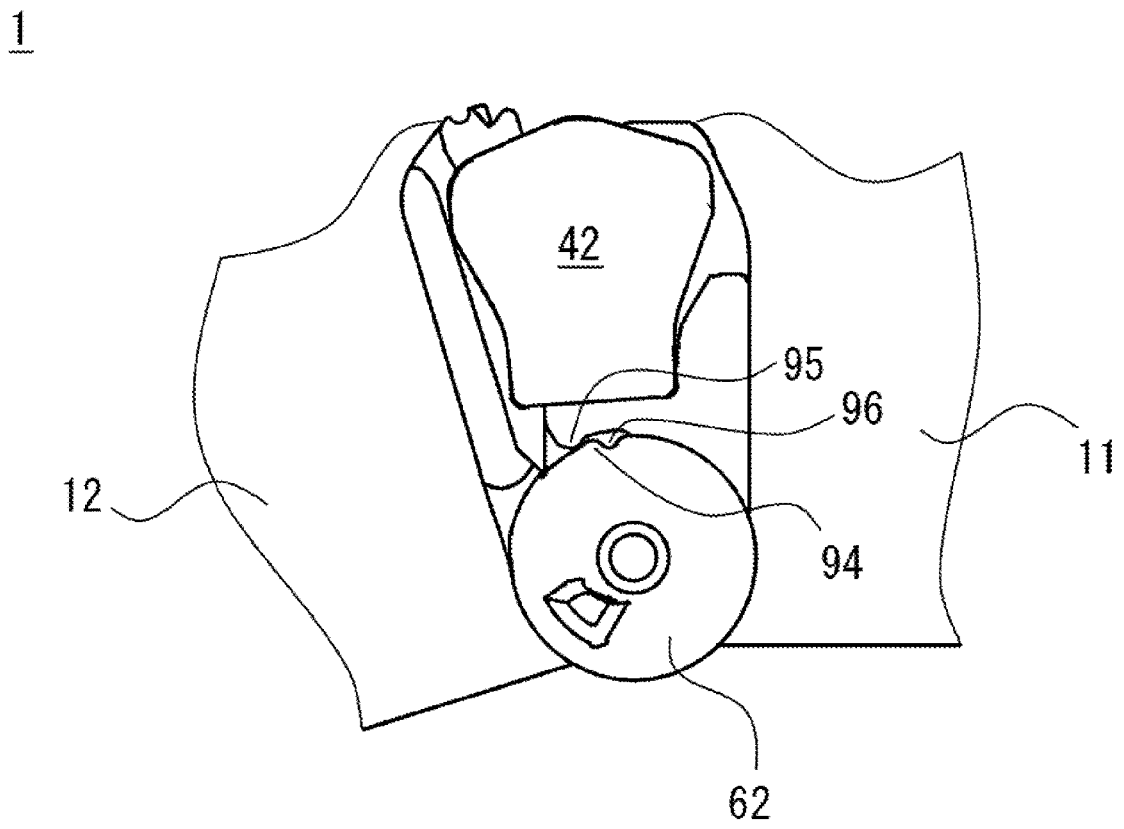

[Fig.21]
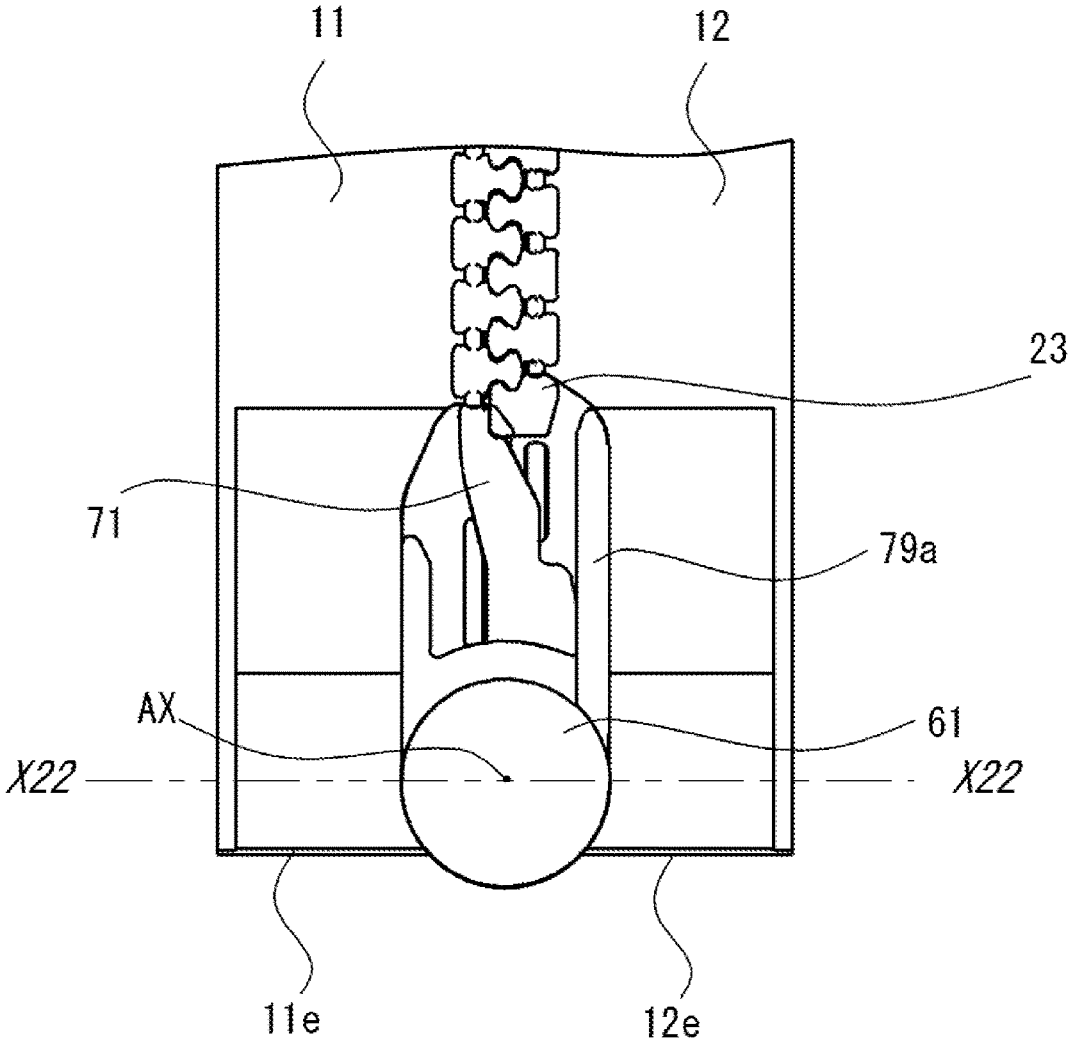

[Fig.22]
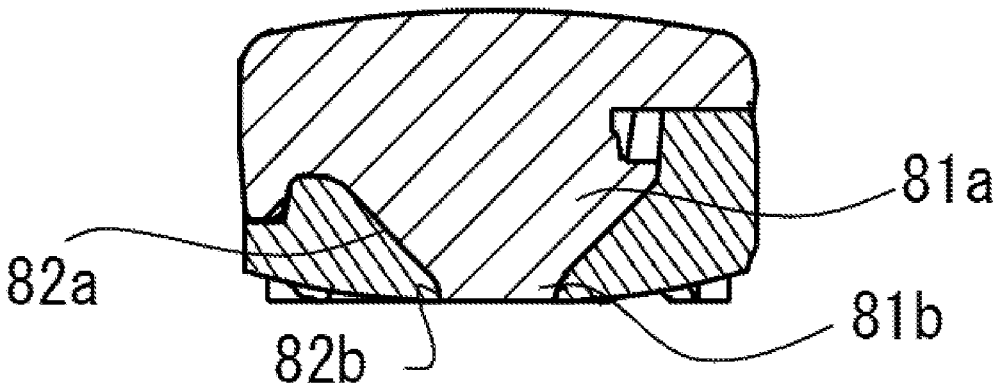

[Fig.23]
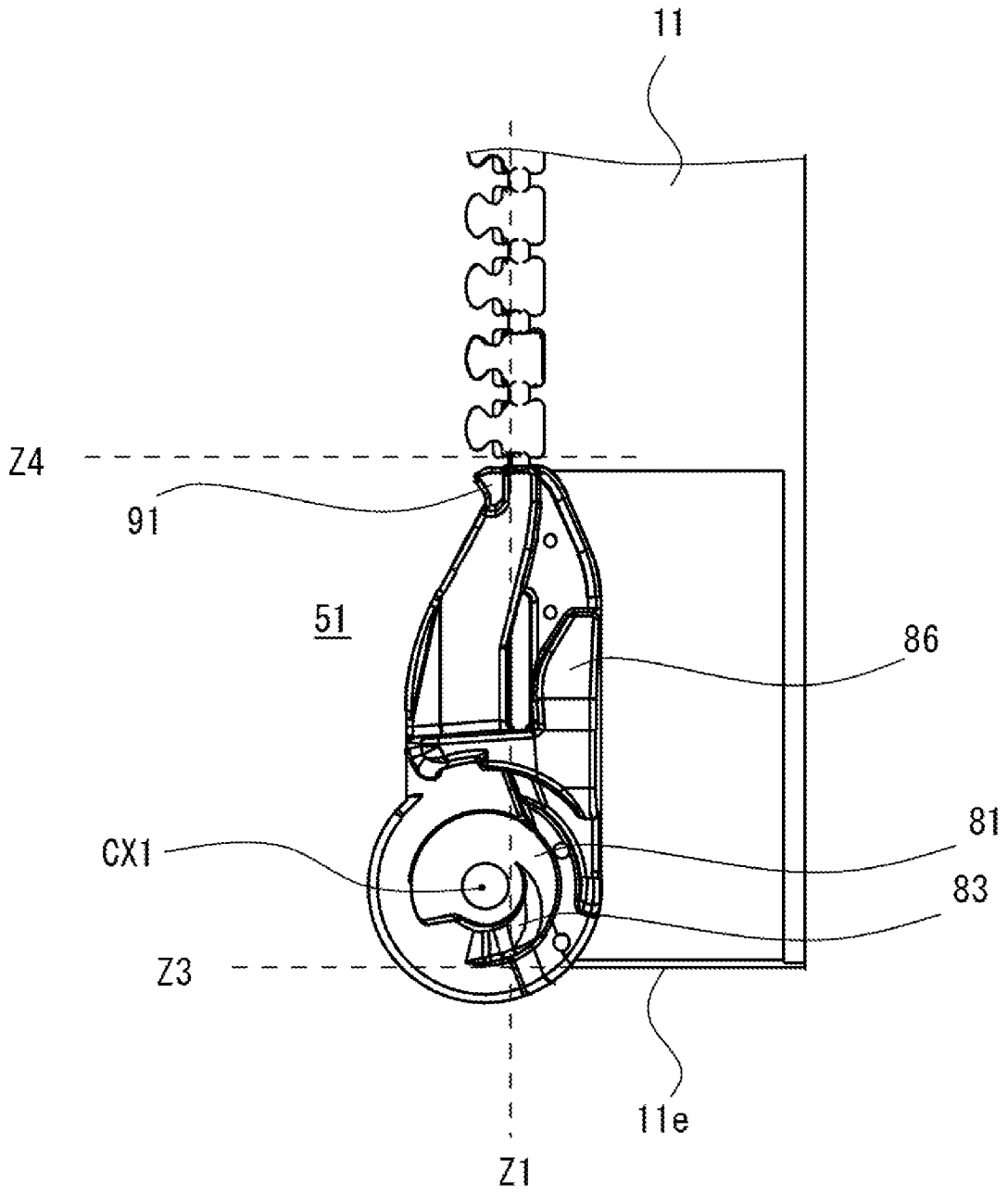

[Fig.24]
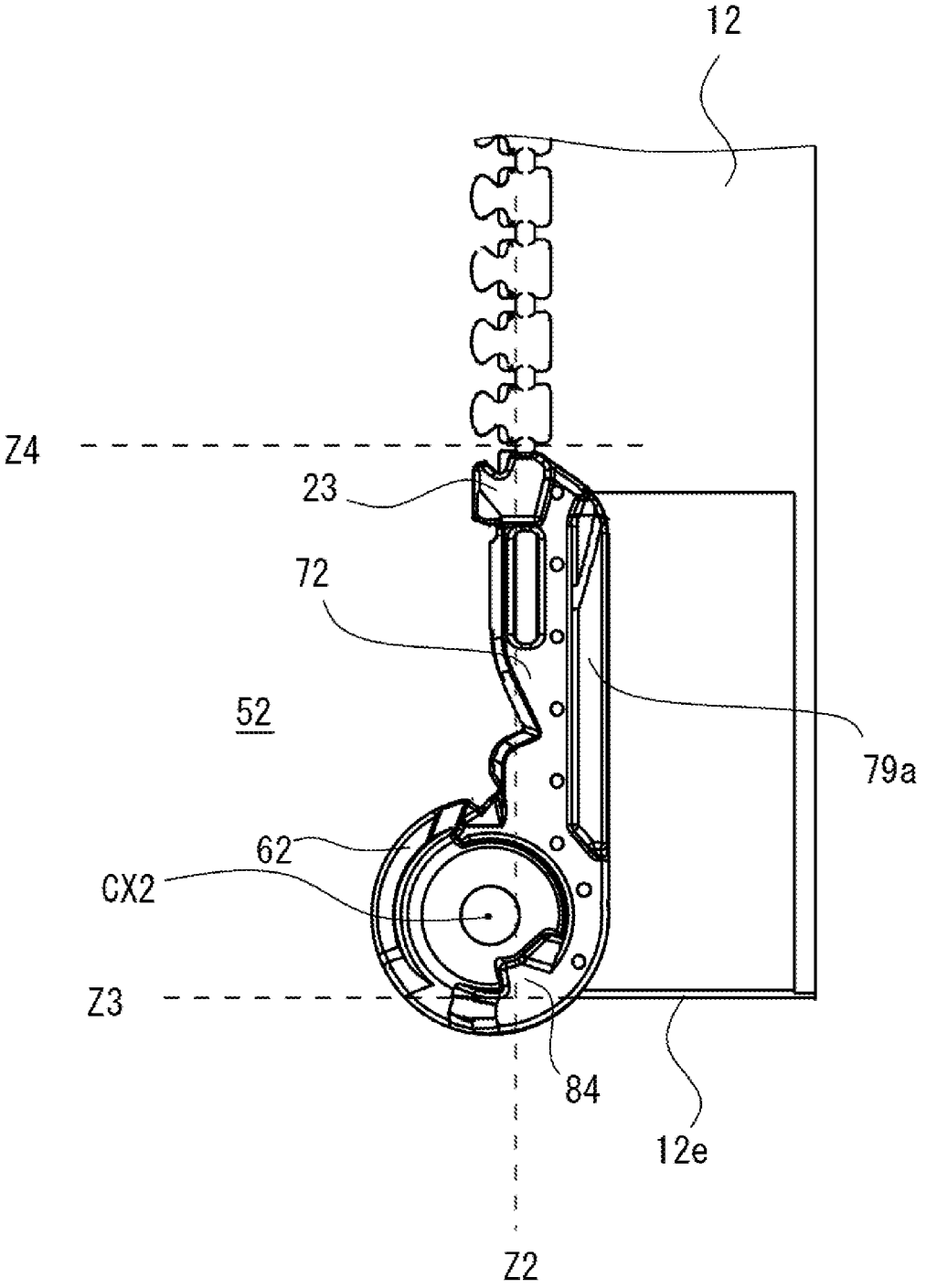

SLIDE FASTENER

CROSS-REFERENCE TO RELATED APPLICATIONS

This application is a U.S. National Stage entry of PCT Application No: PCT/JP2017/034816 filed Sep. 26, 2017, the contents of which are incorporated herein by reference.

TECHNICAL FIELD

The present disclosure is related to a slide fastener.

BACKGROUND ART

PTL 1 discloses at its claim 1 etc. a separable stop in which female engaging portion 34 is provided in a locking part 11 and a male engaging portion 20 is provided in a coupled part 10, and these parts are engageable and separable in a direction orthogonal to a surface of the fastener tape 2 and these parts are rotatable when they are to be engaged. Likewise PTL1, PTL2 discloses a separable stop in which coupling of female part 7 and male part 8 is followed by rotation of the female part 7 and/or the male part 8. Likewise PTL1, PTL3 discloses a separable stop in which coupling of part 10 and part 20 is followed by rotation of the part 10 and/or the part 20.

PTL 4 describes that double helical structures are arranged on respective surfaces of terminal members 420, 422 and the terminal members 420, 422 are pushed together so that appropriately-directed rotation is facilitated for engaging the terminal members 420 and 422 together (See page 10, left-top column).

CITATION LIST

[PTL]

[PTL 1] Japanese Patent Application Laid-open No. 2000-232908

[PTL 2] U.S. Pat. No. 3,733,343

[PTL 3] Japanese Patent Application Laid-open No. 11-221105

[PTL 4] Japanese Patent Application Laid-open No. 55-500279

SUMMARY

Technical Problem

Facilitated operation of first and second stop members required for closing a slide fastener is desired.

Solution to Problem

A slide fastener according to an aspect of the present disclosure has been invented against the above-described teachings. A slide fastener according to an aspect of the present disclosure may include: a first fastener stringer including a first fastener tape and a first fastener element provided on a side-edge portion extending along an elongation direction of the first fastener tape; a second fastener stringer including a second fastener tape and a second fastener element provided on a side-edge portion extending along an elongation direction of the second fastener tape; a slider for opening and closing the first and second fastener stringers, the slider including at least an upper wing, a lower wing, and a connecting pillar that connects the upper wing and the lower wing, first and second front mouths being arranged to sandwich the connecting pillar, one rear mouth being arranged opposite to the first and second front mouths, a first slit extending between the first front mouth and the rear mouth to allow movement of the first fastener tape, and a second slit extending between the second front mouth and the rear mouth to allow movement of the second fastener tape; a first stop member attached to a first tape region located between a terminal end of the first fastener tape and the first fastener element, the first stop member including a first base and a first insert, the first insert being positioned between the first base and the first fastener element, and the first insert being inserted into the slider via the rear mouth of the slider; and a second stop member attached to a second tape region located between a terminal end of the second fastener tape and the second fastener element, the second stop member including a second base and a second insert, the second insert being positioned between the second base and the second fastener element, and the second insert being inserted into the slider via the second slit of the slider, wherein the second insert moves toward the second slit of the slider in accordance with at least one or respective rotations of the first and second bases, and a rotational axis with respect to the at least one or respective rotations of the first and second bases is positioned between the first tape region and the second tape region.

In some embodiments, the first base of the first stop member may be provided with an axial protrusion, and the second base of the second stop member may be provided with a receiving portion that receives the axial protrusion.

In some embodiments, a center line of the axial protrusion may be located between the terminal end of the first fastener tape and the first fastener element in the elongation direction of the first fastener tape.

In some embodiments, a center line of the receiving portion may be located between the terminal end of the second fastener tape and the second fastener element in the elongation direction of the second fastener tape.

In some embodiments, the first and second bases may be stacked via at least one or respective rotations of the first and second bases and, in accordance with this rotation, the second insert may move toward the second slit of the slider and an interspace between the first and second bases may be reduced.

In some embodiments, the first and second bases may have circular-profiled flat plates.

In some embodiments, the respective flat plates of the first and second bases may be stacked via at least one or respective rotations of the first and second bases.

In some embodiments, a peripheral portion of the axial protrusion may be provided with at least one sloped surface that is sloped in an arc around the center line of the axial protrusion, and the receiving portion may be provided with at least one sliding portion that is slidable on the sloped surface.

In some embodiments, an entirety of or at least a portion of the sloped surface may be located between the terminal end of the first fastener tape and the first fastener element in the elongation direction of the first fastener tape.

In some embodiments, an entirety of or at least a portion of the sliding portion may be located between the terminal end of the second fastener tape and the second fastener element in the elongation direction of the second fastener tape.

In some embodiments, the sliding portion may have a contact edge that touches the sloped surface and a projected part that is projected in an opposite direction relative to the contact edge in a circumferential direction of the receiving portion that receives the axial protrusion, and the axial protrusion may be provided with a recess into which the projected part is inserted.

In some embodiments, the sloped surface may descend so as to be away from the first fastener tape.

Advantageous Effects of Invention

According to an aspect of the present disclosure, facilitated operation of first and second stop members required for closing a slide fastener would be promoted, and an extent of protruding of stop member base from terminal end of fastener tape may be reduced.

BRIEF DESCRIPTION OF DRAWINGS

FIG. 1 is a schematic perspective view of an end of a slide fastener according to an aspect of the present disclosure, first and second fastener stringers being not closed.

FIG. 2 is a schematic perspective view of an end of a slide fastener according to an aspect of the present disclosure, viewing the slide fastener of FIG. 1 from the opposite side.

FIG. 3 is a schematic perspective view of a slider incorporated into the slide fastener according to an aspect of the present disclosure. Frontward movement of slider allows closing of first and second fastener stringers. Rearward movement of slider allows opening of the first and second fastener stringers.

FIG. 4 is a schematic side view of a slider incorporated into the slide fastener according to an aspect of the present disclosure.

FIG. 5 is a schematic enlarged perspective view of a first stop member arranged at an end of a first fastener stringer of the slide fastener according to an aspect of the present disclosure.

FIG. 6 is a schematic enlarged perspective view of a second stop member arranged at an end of a second fastener stringer of the slide fastener according to an aspect of the present disclosure.

FIG. 7 is a schematic top view of a first stop member of a slide fastener according to an aspect of the present disclosure.

FIG. 8 is a schematic bottom view of a first stop member of a slide fastener according to an aspect of the present disclosure.

FIG. 9 is a schematic right-side view of a first stop member of a slide fastener according to an aspect of the present disclosure.

FIG. 10 is a schematic left-side view of a first stop member of a slide fastener according to an aspect of the present disclosure. Illustration of fastener tape is omitted.

FIG. 11 is a schematic rear side view of a first stop member of a slide fastener according to an aspect of the present disclosure.

FIG. 12 is a schematic top view of a second stop member of a slide fastener according to an aspect of the present disclosure.

FIG. 13 is a schematic bottom view of a second stop member of a slide fastener according to an aspect of the present disclosure.

FIG. 14 is a schematic right-side view of a second stop member of a slide fastener according to an aspect of the present disclosure. Illustration of fastener tape is omitted.

FIG. 15 is a schematic left-side view of a first stop member of a slide fastener according to an aspect of the present disclosure.

FIG. 16 is a schematic rear side view of a first stop member of a slide fastener according to an aspect of the present disclosure.

FIG. 17 is a schematic view of illustrating that second insert of second stop member moves toward a second slit of a slider while first and second bases are stacked and mated via at least one rotation of or respective rotations of first and second bases of first and second stop members in the slide fastener according to an aspect of the present disclosure, depicting a state just before the second insert enters into the inside of the slider via the second slit of the slider.

FIG. 18 is a schematic view of illustrating that second insert of second stop member moves toward a second slit of a slider while first and second bases are stacked and mated via at least one rotation of or respective rotations of first and second bases of first and second stop members in the slide fastener according to an aspect of the present disclosure, depicting a state after the second insert enters into the inside of the slider via the second slit of the slider.

FIG. 19 is a schematic illustration viewing the slide fastener of FIG. 17 from the opposite side.

FIG. 20 is a schematic illustration viewing the slide fastener of FIG. 18 from the opposite side.

FIG. 21 is a schematic top view of a slide fastener illustrating a mated state of first and second stop members in the slide fastener according to an aspect of the present disclosure.

FIG. 22 is a schematic cross-sectional view taken along a phantom line X22-X22 in FIG. 21. Illustration of fastener tape is omitted for a purpose of simplicity of drawing.

FIG. 23 is a schematic bottom view of first stop member.

FIG. 24 is a schematic top view of second stop member.

DESCRIPTION OF EMBODIMENTS

Hereinafter, non-limiting exemplary embodiments of the present invention will be described with reference to FIGS. 1 to 24. Disclosed one or more exemplary embodiments and respective features included in the exemplary embodiments are not mutually exclusive. A skilled person would be able to combine respective exemplary embodiments and/or respective features without requiring excess descriptions. Also, a skilled person would appreciate synergistic effects of such combinations. Overlapping descriptions among the exemplary embodiments would be basically omitted. Referenced drawings are mainly for describing inventions, and may possibly be simplified for the sake of convenience of illustration.

Plural features described for one slide fastener may be understood as a combination of these features, but may be understood as individual features independent from other features. Individual feature will be understood to be effective not only for a disclosed slide fastener but also for other non-disclosed slide fasteners. Individual feature may be understood as a combination with one or more other features. Recitation of all combinations of individual features should be redundant for a skilled person, and thus omitted. In the present specification, individual feature would be clearly highlighted by a phrase such as "In some embodiments", "In some cases" or the like.

In the present disclosure, terms indicating direction would be understood as follows. Front-rear direction matches a movement direction of a slider. Frontward direction matches a frontward movement direction of a slider for closing first and second fastener stringers. Rearward direction matches a rearward movement direction of a slider for opening first and second fastener stringers. Up-down direction is orthogonal to the front-rear direction and is perpendicular to tape surface of fastener tape. The up-down direction matches an extending direction of a connecting pillar for connecting upper and lower slider wings. Left-right direction is orthogonal to the front-rear direction and the up-down direction. Directions can be redefined in other languages based on the following descriptions.

FIG. 1 is a schematic perspective view of an end of a slide fastener according to an aspect of the present disclosure. First and second fastener stringers 31, 32 are not closed. FIG. 2 is a schematic perspective view of an end of a slide fastener according to an aspect of the present disclosure, viewing the slide fastener of FIG. 1 from the opposite side. FIG. 3 is a schematic perspective view of a slider 40 incorporated into the slide fastener 1 according to an aspect of the present disclosure. Frontward movement of slider 40 allows closing of the first and second fastener stringers 31, 32. Rearward movement of slider 40 allows opening of the first and second fastener stringers 31, 32. FIG. 4 is a schematic side view of a slider 40 incorporated into the slide fastener 1 according to an aspect of the present disclosure. FIG. 5 is a schematic enlarged perspective view of a first stop member 51 arranged at an end of a first fastener stringer 31 of the slide fastener 1 according to an aspect of the present disclosure. FIG. 6 is a schematic enlarged perspective view of a second stop member 52 arranged at an end of a second fastener stringer 32 of the slide fastener 1 according to an aspect of the present disclosure. Note that first fastener elements 21 of first fastener stringer 31 is inserted through a slider 40 not illustrated in FIGS. 1 and 2. This should be well understood by referring to FIGS. 17 and 18.

A slide fastener 1 has first and second fastener stringers 31, 32 as a pair of left and right fastener stringers. The slide fastener 1 further has a slider 40 for opening and closing the first and second fastener stringers 31, 32. The first fastener stringer 31 has a first fastener tape 11, and a first fastener element 21 provided on a side-edge portion extending along the elongation direction of the first fastener tape 11. The second fastener stringer 32 has a second fastener tape 12, and a second fastener element 22 provided on a side-edge portion extending along the elongation direction of the second fastener tape 12. The side-edge portion of the first fastener tape 11 provided with the first fastener element 21 and the side-edge portion of the second fastener tape 12 provided with the second fastener element 22 are arranged to be opposed one another, and may be referred to as opposed side-edge portions.

Each one of fastener tapes is dimensioned so that a length is greater than a width. The elongation direction of fastener tape matches a direction the fastener tape extends so as to have the length, and particularly matches a direction indicated by an arrow A1 in FIG. 1. The elongation direction of fastener tape may be simply referred to as "tape elongation direction". Width direction of fastener tape matches a direction the fastener tape extends so as to have the width, and particularly matches a direction indicated by an arrow A2 in FIG. 1. Width direction of fastener tape may be simply referred to as "tape width direction".

Each one of fastener tape has a pair of tape surfaces that defines a thickness. In detail, the first fastener tape 11 has an upper surface 11*a* and a lower surface 11*b* at the opposite side of the upper surface 11*a*, these tape surfaces defining a thickness of the first fastener tape 11. The second fastener tape 12 also has an upper surface 12*a* and a lower surface 12*b* at the opposite side of the upper surface 12*a*, these tape surfaces defining a thickness of the second fastener tape 12. Surfaces defining the thickness of fastener tape would be referred to as "tape surface".

In some cases including the illustrated example, the first/second fastener element 21, 22 is an arrangement of elements in which plastic-made elements are arranged along the tape elongation direction. Other types of fastener elements such as metal-made elements or coil-like element could be employed. Each one of plastic-made elements has a base fixed to the opposed side-edge portion of the fastener tape, and a head connected to the base via a neck.

The slider 40 incorporated into the slide fastener 1 has an upper wing 41, a lower wing 42, and a connecting pillar 43 connecting the upper and lower wings 41 and 42. First and second front mouths 44*m*, 44*n* are arranged to sandwich the connecting pillar 43. One rear mouth 45 is arranged at the opposite side of the first and second front mouths 44*m*, 44*n* in the front-rear direction. First slit 46*m* extends between the first front mouth 44*m* and the rear mouth 45, allowing the first fastener tape 11 to move therethrough. Second slit 46*n* extends between the second front mouth 44*n* and the rear mouth 45, allowing the second fastener tape 12 to move therethrough.

The slider 40 is provided with an element channel between the upper and lower wings 41 and 42 which is bifurcated into Y-shape by the connecting pillar 43. The first fastener element 21 enters or exits the inside of the slider 40 via the first front mouth 44*m*. The second fastener element 22 enters or exits the inside of the slider 40 via the second front mouth 44*n*. Engaged first and second fastener elements 21, 22 enter or exit the inside of the slider 40 via the rear mouth 45.

Upper wing 41 of the slider 40 includes an upper wing plate 41*a*, and a pair of upper flanges 41*b* downwardly protruded in the left and right side-edges of the upper wing plate 41*a*. Lower wing 42 includes a lower wing plate 42*a*, and a pair of lower flanges 42*b* upwardly protruded in the left and right side-edges of the lower wing plate 42*a*. In some cases, one of the upper and lower flanges 41*b* and 42*b* is omitted. The upper and lower wing plates 41*a* and 42*a* may be arranged in a plane orthogonal to the up-down direction along which the connecting pillar 43 extends. Optionally, the slider 40 has a pull-tab holder bar 48, and a pull tab 49 attached to the upper wing plate 41*a* via the pull-tab holder bar 48. Optionally, the slider 40 has a locking pawl 47 operated by the pull tab 49.

Additionally to the first and second fastener stringers 31, 32 and the slider 40 described above, the slide fastener 1 has a first stop member 51 attached to a first tape region located between a terminal end 11*e* of the first fastener tape 11 and the first fastener element 21, and a second stop member 52 attached to a second tape region located between a terminal end 12*e* of the second fastener tape 12 and the second fastener element 22. The first stop member 51 is slightly protruded rearward from the terminal end 11*e* of the first fastener tape 11. Likewise, the second stop member 52 is slightly protruded rearward from the terminal end 12*e* of the second fastener tape 12. In another case, the first stop member 51 is protruded rearward from the terminal end 11*e* of the first fastener tape 11 in an extent greater or less than that shown in the illustrated example. In some cases, the first stop member 51 is not protruded rearward from the terminal end 11*e* of the first fastener tape 11, and the entirety of the first stop member 51 is positioned frontward of the terminal end 11*e* of the first fastener tape 11. Alternatively or additionally, in some cases, the second stop member 52 is not protruded rearward from the terminal end 12*e* of the second fastener tape 12, and the entirety of the second stop member 52 is positioned frontward of the terminal end 12*e* of the second fastener tape 12. If the stop member is made of plastic, the stop member is adhered to the tape region.

The first stop member 51 has a first base 61, and a first insert 71 positioned between the first base 61 and the first fastener element 21 and to be inserted into the inside of the slider 40 via the rear mouth 45 of the slider 40. The first insert 71 extends from the first base 61 toward the first fastener element 21 along the front-rear direction. The second stop member 52 has a second base 62, and a second insert 72 positioned between the second base 62 and the second fastener element 22 and to be inserted into the inside of the slider 40 via the second slit 46*n* of the slider 40. The second insert 72 extends from the second base 62 toward the second fastener element 22 along the front-rear direction. The second stop member 52 optionally has a third fastener element 23. The third fastener element 23 is connected to a front end of the second insert 72. The third fastener element 23 is arranged adjacent to the second fastener element 22. The third fastener element 23 is provided to facilitate ease of the slider 40 movement when the slider 40 is moved frontward while the first and second inserts 71, 72 are inserted into the inside of the slider 40, and/or is provided to occupy a space between the fastener element and the stop member.

The first insert 71 is shaped suitably to facilitate that the slider 40 is kept staying on the first insert 71. The slider 40 is restricted to move by the first insert 71 when the first insert 71 is inserted into the inside of the slider 40, so that positioning of the slider 40 on the first stop member 51 is facilitated. In some cases, as well understood from FIG. 7, the first insert 71 has a first side surface 71*i* extending linearly in the front-rear direction from the first base 61 or an upper stop wall 85*a* described below, and a second side surface 71*u* gradually slanting leftward as extending frontward from the first side surface 71*i*. The first side surface 71*i* and the second side surface 71*u* are configured in accordance with the profile of the inner side surface of the upper flange 41*b* of the slider 40. Accordingly, when the first insert 71 is fully inserted into the inside of the slider 40, the slider 40 is suppressed from being moved frontward away from the first insert 71.

In some cases, the first insert 71 has upper and lower plates 71*a*, 71*b* at least partially defining an insertion groove 80 to which the second insert 72 is inserted. The first and second inserts 71 and 72 are allowed to be mated, thus suppressing separation of once-mated first and second stop members 51 and 52. As appreciated from descriptions below, the slider 40 is moved frontward after the second insert 72 enters into the inside of the slider 40 via the second slit 46*n* of the slider 40 and, accordingly the second insert 72 is inserted into the insertion groove 80 between the upper and lower plates 71*a* and 71*b* of the first insert 71. Upward and downward motions of the second insert 72 are suitably restricted between the upper and lower plates 71*a* and 71*b*.

In some cases, as well appreciated from FIGS. 7 and 8, the upper plate 71*a* of the first insert 71 has an upper plate slope 71*m* slanting obliquely upward; the lower plate 71*b* has a lower plate slope 71*n* slanting obliquely downward; and an entrance of the insertion groove 80 is positioned between the upper plate slope 71*m* and the lower plate slope 71*n*. In such a case, when the first insert 71 is inserted into the inside of the slider 40, upward and downward motions of the slider 40 are restricted by the first insert 71, thus facilitating that the slider 40 is kept staying on the first insert 71. In some cases, the upper plate slope 71*m* touches the inner surface of the upper wing 41 (or the upper wing plate 41*a*) of the slider 40. The lower plate slope 71*n* touches the inner surface of the lower wing 42 (or the lower wing plate 42*a*) of the slider 40. In some cases, the upper surface of the front end of the upper plate slope 71*m* is a downward sloped surface, thus avoiding or suppressing wear thereof due to contacting the slider 40.

The first stop member 51 may optionally have an upper stop wall 85*a* connected to the upper plate 71*a* of the first insert 71, and a lower stop wall 85*b* connected to the lower plate 71*b* of the first insert 71. In some cases, a height of the lower stop wall 85*b* in the up-down direction is greater than a height of the upper stop wall 85*a* in the up-down direction. In some cases, when the first insert 71 has been fully inserted into the inside of the slider 40 via the rear mouth 45 of the slider 40, the upper stop wall 85*a* has an upper height exceeding upward relative to the upper surface of the upper wing plate 41*a* and the lower stop wall 85*b* has a lower height not exceeding downward relative to the lower surface of the lower wing plate 42*a* in the up-down direction along which the connecting pillar 43 extends. Thinning of the first stop member 51 is facilitated.

The first stop member 51 may optionally have a guide wall 86 connected to the lower stop wall 85*b*. The guide wall 86 extends in the front-rear direction and guides the slider 40 moving onto the first insert 71. The first stop member 51 may optionally have an upper thin plate 87*a* provided leftward of the upper plate 71*a* of the first insert 71, and a lower thin plate 87*b* provided between the lower plate 71*b* of the first insert 71 and the guide wall 86. The upper and lower thin plates 87*a* and 87*b* facilitate fixing of the first stop member 51 to the first fastener tape 11. The second stop member 52 may optionally have upper and lower blocking walls 79*a* and 79*b* protruded upward and downward at a position adjacent to the second insert 72. The upper blocking wall 79*a* can touch the upper flange 41*b* of the slider 40. The lower blocking wall 79*b* can touch the lower flange 42*b* of the slider 40.

In the present embodiment, in accordance with at least one rotation or respective rotations of the first and second bases 61 and 62, the second insert 72 moves toward the second slit 46*n* of the slider 40.

In some cases, the first and second bases 61 and 62 are stacked and/or mated via at least one rotation or respective rotations of the first and second bases 61 and 62, not necessarily limited to this though. In accordance with this rotation, the second insert 72 moves toward the second slit 46*n* of the slider 40, and a distance between the first and second bases 61 and 62 is reduced. In other words, the first and second bases 61 and 62 are sandwiched between thumb and forefinger so that the second insert 72 moves toward the second slit 46*n* of the slider 40 and a distance between the first and second bases 61 and 62 is reduced. Pivoting of the second insert 72 is caused by the first and second bases 61 and 62 being sandwiched between thumb and forefinger, thus reducing operational task of inserting the second insert 72 into the inside of the slider 40. In short, easier operation of the first and second stop members 51 and 52 required when closing the slide fastener 1 would be facilitated.

In the present embodiment, a rotational axis AX with respect to at least one or respective rotations of the first and second bases 61, 62 is positioned between first and second tape regions. The first tape region is a tape region located between the terminal end 11*e* of the first fastener tape 11 and the first fastener element 21. The second tape region is a tape region located between the terminal end 12*e* of the second fastener tape 12 and the second fastener element 22. The rotational axis AX is shown in FIGS. 17, 18 and 21. The rotational axis AX may be understood as an axial line where a center line CX1 of axial protrusion 81 described below and a center line CX2 of receiving portion 82 described below coincide. As would be well understood by additional reference to FIG. 23, the center line CX1 of the axial protrusion 81 is provided at a position offset from the first fastener tape 11 crossing an imaginary line Z1 set along an outline of elongated side-edge portion to which the first fastener elements 21 of the first fastener tape 11 are attached. As would be well understood by additional reference to FIG. 24, the center line CX2 of the receiving portion 82 is provided at a position offset from the second fastener tape 12 crossing an imaginary line Z2 set along an outline of elongated side-edge portion to which the second fastener elements 22 of the first fastener tape 12 are attached.

When designing a separable stop that allows pivoting of the first stop member 51 or the second stop member 52 in accordance with nipping thereof by fingers of a hand (e.g. thumb and forefinger), recommendation may be that the first and second bases 61 and 62 are positioned farther away from the fastener tapes in order to achieve stable and good injection molding. Against this recommendation, in the present embodiment, the rotational axis AX with respect to at least one or respective rotations of the first and second bases 61, 62 is positioned between first and second tape regions, as described above. Accordingly, an extent of rearward protruding of the first base 61 from the terminal end 11*e* of the first fastener tape 11 would be reduced, and an extent of rearward protruding of the second base 62 from the terminal end 12*e* of the second fastener tape 12 would be reduced either. When the first and second fastener stringers 31, 32 are closed, an extent of protruding of the stack of the first and second bases 61, 62 from the terminal ends 11*e*, 12*e* of the first and second fastener tapes 11, 12 would be reduced. In some cases, coupling strength of the fastener tape and the base can be increased. In some cases, the slide fastener 1 can be facilitated to have an improved appearance.

In some cases, the axial protrusion 81 itself or the center line CX1 of the axial protrusion 81 is positioned between the terminal end 11*e* of the first fastener tape 11 and the first fastener element 21 in the elongation direction of the first fastener tape 11. This feature is particularly shown in FIG. 23, and the axial protrusion 81 and the center line CX1 are positioned between an imaginary line Z3 set along the terminal end 11*e* of the first fastener tape 11 and an imaginary line Z4 set along a rear surface of the first fastener element 21.

Additionally or alternatively, the receiving portion 82 itself or the center line CX2 of the receiving portion 82 is positioned between the terminal end 12*e* of the second fastener tape 12 and the second fastener element 22 in the elongation direction of the second fastener tape 12. This feature is particularly shown in FIG. 24, and the receiving portion 82 itself or the center line CX2 of the receiving portion 82 is positioned between an imaginary line Z3 set along the terminal end 12*e* of the second fastener tape 12 and an imaginary line Z4 set along a rear surface of the second fastener element 22.

The entirety of or at least a portion of sloped surface 83 may be positioned between the terminal end 11*e* of the first fastener tape 11 and the first fastener element 21 in the elongation direction of the first fastener tape 11. Additionally or alternatively, the entirety of or at least a portion of sliding portion 84 may be positioned between the terminal end 12*e* of the second fastener tape 12 and the second fastener element 22 in the elongation direction of the second fastener tape 12. The extent of protruding of the base may be facilitated to be reduced.

The first fastener tape 11, the first fastener element 21, and the first fastener stringer 31 may be alternatively referred to as left fastener tape, left fastener element and left fastener stringer, respectively. The second fastener tape 12, the second fastener element 22, and the second fastener stringer 32 may be alternatively referred to as right fastener tape, right fastener element and right fastener stringer, respectively. The first and second stop members 51 and 52 may be alternatively referred to as left and right stop members, respectively. Likewise, the first and second inserts 71 and 72 may be alternatively referred to as left and right inserts, respectively. If appropriate, "first" may be replaced with "left" and "second" may be replaced with "right".

The first and second fastener tapes 11, 12 may be a flexible woven or knitted fabric. The slider 40 may be made of metal or plastic. The first and second stop members 51, 52 may be made of plastic, but not necessarily limited thereto and maybe made of other materials such as metal. As a non-limiting example, the fastener elements are attached to the fastener tape through injection molding. This is followed by the stop member being attached to the fastener tape through injection molding. This is followed by a slider being engaged with the fastener elements of one fastener stringer. A slide fastener 1 can be manufactured as such.

Hereinafter, non-limiting features regarding the first and second bases 61 and 62 will be described with reference to FIGS. 5 and 6. In some cases, the first base 61 of the first stop member 51 is provided with the axial protrusion 81, and the second base 62 of the second stop member 52 is provided with the receiving portion 82 that receives the axial protrusion 81. The axial protrusion 81 is provided in the first base 61 so that reduced thickness of the second base 62 is facilitated, possibly allowing easier use or improved appearance of the slide fastener 1. In the first stop member 51, the axial protrusion 81 is provided in the first base 61 using a space corresponding to the thickness of the slider 40 in the up-down direction, and the existence of the axial protrusion 81 is less conspicuous compared to a case where it is provided in the second base 62. Note that, the axial protrusion 81 is received by the receiving portion 82, securing easier or reliable initial alignment of the first and second bases 61 and 62 and/or improving stability of the rotation of the second base 62 relative to the first base 61 and/or the rotation of the first base 61 relative to the second base 62.

In some cases, the peripheral portion of the axial protrusion 81 is provided with at least one sloped surface 83 that is sloped in an arc around the center line CX1 of the axial protrusion 81, and the receiving portion 82 is provided with at least one sliding portion 84 that is slidable on the sloped surface 83. When the first and second bases 61 and 62 are co-axially arranged and then the first and second bases 61 and 62 are nipped by thumb and forefinger, the sliding portion 84 descends the sloped surface 83 (See allow D5 in FIG. 5). As such, a vertical force is transformed into a rotational force for the first and/or second bases 61, 62 and as a result, causing the second insert 72 to move toward the second slit 46*n* of the slider 40. Note that, as the sliding portion 84 descends the sloped surface 83, an interspace between the first and second bases 61 and 62 is reduced. When the sliding portion 84 finishes descending the sloped surface 83, the interspace between the first and second bases 61 and 62 is reduced to be a minimum or substantially zero.

In some cases, the sliding portion 84 is protruded inward of the receiving portion 82, in more detail is protruded radially inward regarding the receiving portion 82 that receives the axial protrusion 81. Co-axial arrangement of the first base 61 and the second base 62 is achieved by placing the first base 61 onto the second base 62. At this moment, the axial protrusion 81 of the first base 61 is inserted into the receiving portion 82 of the second base 62, and the center line CX1 of the axial protrusion 81 and the center line CX2 of the receiving portion 82 coincide. These coinciding center lines CX1 and CX2 are shown as a rotational axis AX in FIG. 17. Note that, envisioned is that the first base 61 is placed onto the second base 62 such that the center line CX1 and the center line CX2 do not coincide. Even in such a case, while or as a result of that the first and second bases 61 and 62 are nipped by thumb and forefinger, the center lines CX1 and CX2 may coincide.

In some cases, the sloped surface 83 has two or more sloped surfaces arranged at different positions in a radial direction of the axial protrusion 81. Additionally, these two or more sloped surfaces may be arranged adjacently in a radial direction of the axial protrusion 81. Additionally, these two or more sloped surfaces may be arranged at different positions in a circumferential direction of the axial protrusion 81. Arranging the two or more sloped surfaces with different degree of slope and/or different surface shape allows facilitation of proper aligning of the first and second bases 61 and 62. As would be well understood from FIG. 5, in some cases, the sloped surface 83 includes a first sloped surface 83*a* radially inwardly arranged in a radial direction of the axial protrusion 81 and a second sloped surface 83*b* radially outwardly arranged in a radial direction of the axial protrusion 81. The first and second sloped surfaces 83*a* and 83*b* are arranged adjacently in the radial direction. The first and second sloped surfaces 83*a* and 83*b* are arranged at different positions in the circumferential direction. Degree of slope and/or surface shape of the first sloped surface 83*a* differs from degree of slope and/or surface shape of the second sloped surface 83*b*. An embodiment is envisioned where a third sloped surface is arranged.

In some cases, the sloped surface 83 is sloped downward away from the first fastener tape 11. The thickness becomes thinner in the downward direction of the sloped surface 83. In a case where the sloped surface 83 is sloped downward away from the first fastener tape 11, a thicker portion having greater thickness can be arranged closer to the first fastener tape 11 and a thinner portion having smaller thickness can be arranged farther away from the first fastener tape 11, thus possibly increasing an attachment strength of the first stop member 51 to the first fastener tape 11.

In some cases, the sliding portion 84 has a contact edge 84*a* that touches the sloped surface 83, and a projected part 84*b* that is projected in the opposite direction relative to the contact edge 84*a* in the circumferential direction regarding the receiving portion 82 that receives the axial protrusion 81 (e.g. in the circumferential direction of the center line XC2 of the receiving portion 82) (See FIG. 12), and the axial protrusion 81 is provided with a recess 81*j* to which the projected part 84*b* is inserted (See FIG. 9). In some cases, when the sliding portion 84 finishes descending the sloped surface 83, the projected part 84*b* and the recess 81*j* are fitted. Accordingly, separation of the first and second bases 61 and 62 in the up-down direction is avoided or suppressed. The axial protrusion 81 has a projection 81*c* formed by the recess 81*j*, and an opening 84*c* for receiving the projection 81*c* is formed under the projected part 84*b* (See FIG. 12). The opening 84*c* may penetrate or not penetrate through the second base 62. In some cases, the upper surface of the projected part 84*b* is a sloped surface that descends towards the tip of the projected part 84*b*.

In some cases, the axial protrusion 81 includes a frustum 81*a* and a cylindrical end 81*b* connected to the frustum 81*a*. The receiving portion 82 has a main portion 82*a* for receiving the frustum 81*a* and a bottom hole 82*b* that receives the cylindrical end 81*b*. In some cases, a side surface of the cylindrical end 81*b* defines a smaller angle with the center line CX1 of the axial protrusion 81 compared with the side surface of the frustum 81*a*. In some cases, the side surface of the cylindrical end 81*b* includes a region parallel to the center line CX1 of the axial protrusion 81. When the axial protrusion 81 is received by the receiving portion 82, the cylindrical end 81*b* is fitted with the bottom hole 82*b*, thus the bottom hole 82*b* impeding a movement of the cylindrical end 81*b* in particular in a plane orthogonal to the up-down direction. Accordingly, unintentional separation of the first and second bases 61 and 62 is avoided or suppressed.

The axial protrusion 81 may be arranged in the central portion of the first base 61 having a circular shape viewed along the up-down direction. The receiving portion 82 may be arranged in the central portion of the second base 62 having a circular shape viewed along the up-down direction. The axial protrusion 81 is provided on the upper surface of the first base 61, and extends along the center line CX1 that is parallel to the up-down direction. The receiving portion 82 is provided to penetrate through the second base 62, and extends along the center line CX2 that is parallel to the up-down direction.

In some cases, the first and second bases 61 and 62 each has a flat plate 61*j*, 62*j* with a circular profile. The axial protrusion 81 extends downward from the lower surface of the flat plate 61*j*. The receiving portion 82 is provided like a concave in the upper surface of the flat plate 62*j*. The receiving portion 82 penetrates through the flat plate 62*j* in some cases and does not penetrate through the flat plate 62*j* in other cases. In some cases, the respective flat plates 61*j*, 62*j* may be portions stacked through at least one or respective rotations of the first and second bases 61 and 62. The flat plates 61*j*, 62*j* may be stacked in the up-down direction.

In some cases, the first fastener element 21 includes a line of first fastener elements 21 and the second fastener element 22 includes a line of second fastener elements 22. The third fastener element 23 is connected to the second insert 72 at a position adjacent to an end of the line of second fastener elements 22. As shown in FIG. 17, the third fastener element 23 has a base portion 23*a* fixed to the second fastener tape 12, and a head 23*c* connected to the base portion 23*a* via a neck. Width W23 of the head of the third fastener element 23 along the elongation direction of the second fastener tape 12 is greater than 1.4 times the pitch interval W22 of the second fastener elements 22 in the line of second fastener elements 22. In some cases, the width W23 of the head is less than 2 times the pitch interval W22. When one attempts to move the slider 40 frontward under a condition where the first base 61 is improperly placed onto the second base 62, the third fastener element 23 cannot be engaged with the first fastener element 21 inside the slider 40, thus avoiding or suppressing that the first and second fastener elements 21 and 22 are engaged with the first and second stop members 51 and 52 unmated.

FIGS. 17 and 18 are schematic views for illustrating that the second insert 72 of the second stop member 52 moves toward the second slit 46*n* of the slider 40 while the first and second bases 61 and 62 are stacked and mated via at least one rotation of or respective rotations of the first base 61 of the first stop member 51 and the second base 62 of the second stop member 52 in the slide fastener 1 according to an aspect of the present disclosure. FIG. 17 illustrates a state just before the second insert 72 enters into the inside of the slider 40 via the second slit 46*n* of the slider 40. FIG. 18 illustrates a state after the second insert 72 enters into the inside of the slider 40 via the second slit 46*n* of the slider 40. FIG. 19 is a schematic illustration viewing the slide fastener 1 of FIG. 17 from the opposite side. FIG. 20 is a schematic illustration viewing the slide fastener 1 of FIG. 18 from the opposite side. FIG. 21 is a schematic top view illustrating a mated state of first and second stop members 51 and 52 in the slide fastener 1 according to an aspect of the present disclosure. FIG. 22 is a schematic cross-sectional view taken along a phantom line X22-X22 in FIG. 21. Note that, in some cases, coupling of the first and second bases 61 and 62 indicates a state in which separation of the two is impeded in any at least one direction, e.g. in the up-down direction or in the left-right direction.

In order to close the first and second fastener stringers 31 and 32, the slider 40 is firstly placed on the first stop member 51. The first insert 71 of the first stop member 51 enters into the inside of the slider 40 via the rear mouth 50 of the slider 40. The upper wing 41 (or the upper wing plate 41*a*) of the slider 40 touches the upper stop wall 85*a* connected to the upper plate 71*a* of the first insert 71, and the lower wing 42 (or the lower wing plate 42*a*) of the slider 40 touches the lower stop wall 85*b* connected to the lower plate 71*b* of the first insert 71. The first base 61 and the second base 62 are co-axially arranged, and the axial protrusion 81 of the first base 61 is inserted into the receiving portion 82 of the second base 62. The first and second bases 61 and 62 are nipped by thumb and forefinger, so that rotation of the first base 61 and/or the second base 62 is caused and the sliding portion 84 of the second base 62 descends the sloped surface 83 provided in the peripheral portion of the axial protrusion 81. At this moment, the second insert 72 of the second stop member 52 moves towards the second slit 46*n* of the slider 40 and enters into the inside of the slider 40 via the second slit 46*n*. The vertical interspace between the first and second bases 61 and 62 is reduced, and finally the first base 61 is stacked onto the second base 62 and both are mated. When the sliding portion 84 finishes descending the sloped surface 83, the projected part 84*b* of the sliding portion 84 is inserted into the recess 81*j* of the axial protrusion 81. The second insert 72 will be inserted into the insertion groove 80 between the upper and lower plates 71*a* and 71*b* of the first insert 71 in accordance with frontward movement of the slider 40.

As would be understood from FIGS. 19 and 20, in accordance with rotation of the first base 61 and/or the second base 62, a bulged portion 94 provided on the peripheral portion of the second base 62 of the second stop member 52 overpasses a small protuberant part 95 provided on the lower stop wall 85*b* of the first stop member 51, and reaches a dent 96 adjacently arranged to the small protuberant part 95. During this process, vibratory stimulus is transmitted to the fingers of a manipulator of the slide fastener 1, and he or she is notified of a state the slider 40 is ready to be moved frontward.

When the slider 40 is moved frontward, mating of the first and second stop member 51 and 52 would be completed. The cylindrical end 81*b* is fitted with the bottom hole 82*b*, avoiding or suppressing separation of the first and second bases 61 and 62 due to a possible slipping between the frustum 81*a* and the main portion 82*a*.

Based on the above teachings, a skilled person in the art would be able to add various modifications to the respective embodiments. Reference numerals in Claims are just for reference and should not be referred for the purpose of narrowly construing the scope of claims.

REFERENCE SIGNS LIST

11 First fastener tape
12 Second fastener tape
21 First fastener element
22 Second fastener element
31 First fastener stringer
32 Second fastener stringer
40 Slider
71 First insert
72 Second insert

The invention claimed is:

1. A slide fastener comprising:

a first fastener stringer including a first fastener tape and a first fastener element provided on a side-edge portion extending along an elongation direction of the first fastener tape;

a second fastener stringer including a second fastener tape and a second fastener element provided on a side-edge portion extending along an elongation direction of the second fastener tape;

a slider for opening and closing the first and second fastener stringers, the slider including at least an upper wing, a lower wing, and a connecting pillar that connects the upper wing and the lower wing, first and second front mouths being arranged to sandwich the connecting pillar, one rear mouth being arranged opposite to the first and second front mouths, a first slit extending between the first front mouth and the rear mouth to allow the first fastener tape to move therethrough, and a second slit extending between the second front mouth and the rear mouth to allow the second fastener tape to move therethrough;

a first stop member attached to a first tape region located between a terminal end of the first fastener tape and the first fastener element the first stop member including a first base and a first insert, the first insert being positioned between the first base and the first fastener element and the first insert being inserted into the slider via the rear mouth of the slider; and a second stop member attached to a second tape region located between a terminal end of the second fastener tape and the second fastener element the second stop member including a second base and a second insert, the second insert being positioned between the second base and the second fastener element, and the second insert being inserted into the slider via the second slit of the slider, wherein the second insert moves toward the second slit of the slider in accordance with at least one or respective rotations of the first and second bases, and a rotational axis with respect to the at least one or respective rotations of the first and second bases is positioned between the first tape region and the second tape region, wherein the first base of the first stop member is provided with an axial protrusion, and the second base of the second stop member is provided with a receiving portion that receives the axial protrusion, and, wherein a peripheral portion of the axial protrusion is provided with at least one sloped surface that is rotationally sloped as extending in an arc around a center line of the axial protrusion, and the receiving portion is provided with at least one sliding portion that is slidable on the sloped surface.

2. The slide fastener of claim 1 wherein the center line of the axial protrusion is located between the terminal end of the first fastener tape and the first fastener element in the elongation direction of the first fastener tape.

3. The slide fastener of claim 1 wherein a center line of the receiving portion is located between the terminal end of the second fastener tape and the second fastener element in the elongation direction of the second fastener tape.

4. The slide fastener of claim 1 wherein an entirety of or at least a portion of the sloped surface is located between the terminal end of the first fastener tape and the first fastener element in the elongation direction of the first fastener tape.

5. The slide fastener of claim 1 wherein an entirety of or at least a portion of the sliding portion is located between the terminal end of the second fastener tape and the second fastener element in the elongation direction of the second fastener tape.

6. The slide fastener of claim 1 wherein the sliding portion has a contact edge that touches the sloped surface and a projected part that is projected in an opposite direction relative to the contact edge in a circumferential direction of the receiving portion that receives the axial protrusion, and the axial protrusion is provided with a recess into which the projected part is inserted.

7. The slide fastener of claim 1 wherein the sloped surface descends so as to be away from the first fastener tape.

8. A slide fastener comprising:

a first fastener stringer including a first fastener tape and a first fastener element provided on a side-edge portion extending along an elongation direction of the first fastener tape;

a second fastener stringer including a second fastener tape and a second fastener element provided on a side-edge portion extending along an elongation direction of the second fastener tape;

a slider for opening and closing the first and second fastener stringers, the slider including at least an upper wing, a lower wing, and a connecting pillar that connects the upper wing and the lower wing, first and second front mouths being arranged to sandwich the connecting pillar, one rear mouth being arranged opposite to the first and second front mouths, a first slit extending between the first front mouth and the rear mouth to allow the first fastener tape to move therethrough, and a second slit extending between the second front mouth and the rear mouth to allow the second fastener tape to move therethrough;

a first stop member attached to a first tape region located between a terminal end of the first fastener tape and the first fastener element the first stop member including a first base and a first insert, the first insert being positioned between the first base and the first fastener element and the first insert being inserted into the slider via the rear mouth of the slider; and a second stop member attached to a second tape region located between a terminal end of the second fastener tape and the second fastener element the second stop member including a second base and a second insert, the second insert being positioned between the second base and the second fastener element, and the second insert being inserted into the slider via the second slit of the slider, wherein the second insert moves toward the second slit of the slider in accordance with at least one or respective rotations of the first and second bases, and a rotational axis with respect to the at least one or respective rotations of the first and second bases is positioned between the first tape region and the second tape region, wherein the first and second bases have circular-profiled flat plates, and wherein the first and second bases are stacked via the at least one or respective rotations of the first and second bases and, in accordance with the at least one or respective rotations, an interspace between the first and second bases is reduced and causing the second insert moves toward the second slit of the slider.

9. The slide fastener of claim 8 wherein the respective flat plates of the first and second bases are stacked via the at least one or respective rotations of the first and second bases.

* * * * *